US008394005B2

(12) United States Patent
Solow et al.

(10) Patent No.: US 8,394,005 B2
(45) Date of Patent: Mar. 12, 2013

(54) EXERCISE TABLE

(75) Inventors: Howard Jay Solow, Boulder, CO (US); Julie Lobdell, Longmont, CO (US); Nicholas D. Smith, Fort Collins, CO (US); Chad Follmar, Louisville, CO (US); Jeffery T. Samson, Boulder, CO (US); Nicholas Aldo Nespeca, Eldorado Springs, CO (US)

(73) Assignee: Mad Dogg Athletics, Inc., Venice, CA (US)

( * ) Notice: Subject to any disclaimer, the term of this patent is extended or adjusted under 35 U.S.C. 154(b) by 0 days.

(21) Appl. No.: 12/555,460

(22) Filed: Sep. 8, 2009

(65) Prior Publication Data

US 2010/0004101 A1 Jan. 7, 2010

Related U.S. Application Data

(63) Continuation-in-part of application No. PCT/US2007/084230, filed on Nov. 9, 2007.

(51) Int. Cl.

| | |
|---|---|
| ***A63B 21/068*** | (2006.01) |
| ***A63B 21/04*** | (2006.01) |
| ***A63B 22/20*** | (2006.01) |

(52) U.S. Cl. ..... 482/121; 482/96; 482/130; 482/135; 482/142; 482/145

(58) Field of Classification Search ..... 482/92, 482/101, 121–123, 129, 130, 133, 135, 142, 482/145, 907, 51, 96, 132, 143; 108/53.3, 108/91; 5/8

See application file for complete search history.

(56) References Cited

U.S. PATENT DOCUMENTS

| | | | | |
|---|---|---|---|---|
| 1,621,477 | A | 3/1927 | Pilates | |
| 1,738,987 | A | 12/1929 | Dattilo | |
| 1,934,389 | A * | 11/1933 | Ulsh | 108/53.3 |
| 2,733,922 | A | 2/1956 | Diego | |
| 3,770,267 | A | 11/1973 | McCarthy | |
| 3,866,914 | A * | 2/1975 | Jackson | 473/438 |
| 4,023,818 | A | 5/1977 | Troller | |
| 4,706,953 | A | 11/1987 | Graham | |
| 4,884,802 | A | 12/1989 | Graham | |

(Continued)

FOREIGN PATENT DOCUMENTS

| | | |
|---|---|---|
| CH | 332 368 | 10/1958 |
| CH | 369 404 | 5/1963 |

(Continued)

OTHER PUBLICATIONS

Pilates, Pilates Allegro® Reformer, www.pilates.com, Oct. 22, 2010, 2 pages.

(Continued)

*Primary Examiner* — Loan Thanh
*Assistant Examiner* — Victor K Hwang

(57) ABSTRACT

An exercise table which finds use in Pilates exercising includes an outer framework, a slidably movable support platform, and a foot bar against which a user's feet can be engaged while sliding the support platform against the bias of springs by extending and retracting the user's legs. The frame has supporting legs which are tapered inwardly and downwardly so that one exercise table can be nestably stacked on another by inserting the tapered legs of an overlying exercise table through an opening in the frame of an underlying table until the frames themselves are closely adjacent. The foot bar, shoulder blocks, and pulleys used in operation of the table are also movable between elevated use positions and lowered storage positions to facilitate closely adjacent nestable stacking of identical exercise tables. Various systems are disclosed for accommodating different sized individuals while retaining desired resistance from resilient elements incorporated into the table.

18 Claims, 27 Drawing Sheets

U.S. PATENT DOCUMENTS

| | | | | |
|---|---|---|---|---|
| 5,066,005 | A | 11/1991 | Luecke | |
| 5,338,278 | A | 8/1994 | Endelman | |
| 5,364,327 | A | 11/1994 | Graham | |
| 5,607,381 | A | 3/1997 | Endelman | |
| 5,616,107 | A | 4/1997 | Simonson | |
| 5,653,670 | A * | 8/1997 | Endelman | 482/142 |
| 5,681,249 | A | 10/1997 | Endelman | |
| 5,772,560 | A | 6/1998 | Armstrong | |
| 5,792,033 | A | 8/1998 | Merrithew | |
| 5,807,217 | A | 9/1998 | Endelman | |
| 5,899,834 | A | 5/1999 | Dalebout | |
| 6,045,491 | A * | 4/2000 | McNergney et al. | 482/121 |
| 6,120,425 | A * | 9/2000 | Endelman | 482/142 |
| 6,186,929 | B1 | 2/2001 | Endelman et al. | |
| 6,338,704 | B1 * | 1/2002 | Endelman | 482/142 |
| 6,371,895 | B1 | 4/2002 | Endelman et al. | |
| 6,394,933 | B1 | 5/2002 | Yu | |
| 6,461,408 | B2 | 10/2002 | Buxbaum | |
| 6,527,685 | B2 * | 3/2003 | Endelman et al. | 482/121 |
| 6,685,606 | B2 * | 2/2004 | Endelman | 482/142 |
| 6,926,650 | B2 * | 8/2005 | Endelman et al. | 482/121 |
| 6,971,976 | B2 | 12/2005 | Endelman et al. | |
| 7,104,937 | B2 * | 9/2006 | Arbuckle et al. | 482/142 |
| 7,125,368 | B2 * | 10/2006 | Endelman | 482/142 |
| 7,125,369 | B2 | 10/2006 | Endelman | |
| 7,125,370 | B1 | 10/2006 | Schaffner et al. | |
| 7,163,498 | B1 * | 1/2007 | Abelbeck | 482/142 |
| 7,163,500 | B2 * | 1/2007 | Endelman et al. | 482/142 |
| 7,270,628 | B2 | 9/2007 | Camanaro et al. | |
| 7,288,053 | B2 * | 10/2007 | Endelman et al. | 482/142 |
| 7,294,098 | B2 * | 11/2007 | Barnard et al. | 482/142 |
| 7,306,549 | B2 | 12/2007 | Francis | |
| 7,465,261 | B2 * | 12/2008 | Barnard et al. | 482/142 |
| 7,674,211 | B2 * | 3/2010 | Uygan | 482/123 |
| 7,682,297 | B2 * | 3/2010 | Graham | 482/122 |
| 7,857,736 | B2 | 12/2010 | Merrithew | |
| 2001/0056011 | A1 | 12/2001 | Endelman et al. | |
| 2002/0151419 | A1 | 10/2002 | Barnes et al. | |
| 2003/0119636 | A1 | 6/2003 | Endelman | |
| 2004/0176227 | A1 | 9/2004 | Endelman | |
| 2005/0113227 | A1 * | 5/2005 | Endelman et al. | 482/142 |
| 2006/0293156 | A1 * | 12/2006 | Trees | 482/148 |
| 2007/0087921 | A1 | 4/2007 | Graham | |
| 2008/0248935 | A1 * | 10/2008 | Solow et al. | 482/142 |
| 2009/0247376 | A1 * | 10/2009 | Merrithew et al. | 482/121 |
| 2010/0004101 | A1 | 1/2010 | Solow et al. | |

FOREIGN PATENT DOCUMENTS

| | | |
|---|---|---|
| DE | 17 89 189 | 5/1959 |
| DE | 16 58 736 | 11/1970 |
| DE | 33 13 839 | 11/1984 |
| EP | 0 174 896 | 3/1986 |
| FR | 2 625 907 | 7/1989 |
| FR | 2 661 155 | 10/1991 |
| WO | WO 02/083251 | 10/2002 |
| WO | WO 03/081987 A1 | 10/2003 |
| WO | WO 2005/051496 A2 | 6/2005 |
| WO | WO 2009/061321 | 5/2009 |
| WO | WO 2009061321 A1 * | 5/2009 |

OTHER PUBLICATIONS

Stott Pilates, SPX Max Reformer, http://store.stottpilates.com, Oct. 22, 2010, 2 pages.

European Patent Office, Supplementary European Search Report, May 20, 2011, 4 pages, Munich, Germany.

* cited by examiner

EXERCISE TABLE

CROSS-REFERENCE TO RELATED APPLICATION

This is a continuation-in-part of PCT Application No. PCT/US2007/084230, filed Nov. 9, 2007, to which priority is claimed and which is hereby incorporated by reference in its entirety.

BACKGROUND OF THE INVENTION

1. Field of the Invention

The present invention relates generally to exercise equipment and more particularly to an exercise table commonly referred to as a "Reformer" and used in Pilates type exercise. The table includes an outer framework with a reciprocating spring-biased support platform or carriage on which a user is supported for reciprocating movement and a foot bar against which the user may engage his or her feet. A pair of legs at the head and foot of the table support the framework with the legs being tapered. An opening through the frame is provided vertically above each leg so inserting the legs of an overlying table through an opening in the frame of an underlying table and into closely adjacent relationship with the legs of the underlying table can nestably stack a plurality of the tables. The table includes other features for facilitating nestable stacking.

2. Description of the Relevant Art

Exercise by human beings has become increasingly popular for health and other related reasons. Such exercise takes numerous forms including aerobics, strengthening, and more recently exercises related to Pilates, Gyrotonics and the like. Some of these exercises can be done without equipment while others require equipment. Some exercises associated with Pilates require a table having a spring-resisted platform on which a user lies. A foot bar against which the user can apply pressure to reciprocally move the platform is provided along with a hand-pulled rope for the same purpose. An exercise table for use in such exercises is commonly referred to as a "Reformer." Inasmuch as the Reformers can be used in home or in a classroom setting where there are numerous such Reformers, storage for the Reformers becomes an issue. For example, a Reformer, if used in a class setting, requires substantial space for storage because there is a plurality of such Reformers. The Reformers preferably include a generally horizontal frame that is supported by legs, which elevate the frame to an operating height. When the Reformers are stacked for storage purposes, the legs rest on the underlying frame of an adjacent Reformer so the full height of the Reformer is required in a stack of such Reformers. Accordingly, while the Reformer itself serves a very useful purpose, it would be far more desirable if it could be stored in a manner requiring less space while also being configured at the desired working height, which of course is valuable in exercise facilities such as health clubs.

It is to provide an improved Reformer that can be stored in a relatively small amount of space that the present invention has been developed.

SUMMARY OF THE INVENTION

The exercise table or "Reformer" of the present invention is similar to Reformers known in the art in that it includes a peripheral rectangularly-shaped frame defining longitudinal tracks on opposite sides and head and foot end components. Adjacent the foot component of the frame, a pivotal foot bar is adjustably positioned at a location for engagement by a user of the table with the user lying on a reciprocable platform that is spring biased toward the foot end of the frame but supported on rollers which ride in the longitudinal tracks of the frame. In this manner, an individual lying on the platform with his feet against the foot bar can extend his legs causing the platform on which he is seated to roll longitudinally of the table against the spring bias and return when the user's legs are again bent. The foot bar is adjustable between different use positions and also a storage position in which the foot bar rests upon the platform in contiguous relationship therewith and closely adjacent to the horizontal plane of the framework.

The support platform also includes a coplanar head rest and a pair of pivotally mounted shoulder blocks which are movable between a use position wherein they extend vertically upwardly above the plane of the support platform for engagement by a user's shoulders and a folded position where they are substantially coplanar with the support platform and the horizontal plane of the framework for storage purposes.

Vertically adjustable pulleys are also mounted on the head end component of the framework and are telescopically movable between an elevated use position and a lowered storage position with the lowered storage position being closely adjacent to the horizontal plane of the frame. In the elevated position, the pulleys cooperate with hand-manipulated ropes for also moving the support platform against the spring bias.

It will be appreciated from the above that while the foot bar, the shoulder blocks, and the pulleys can be elevated for use in operating the exercise table, they can also be lowered into a storage position closely adjacent to the horizontal level of the frame of the exercise table to minimize the space occupied when the exercise tables are stacked in storage.

The frame for the exercise table is supported at opposite ends with head and foot legs, which have downwardly and inwardly inclined side components and a horizontal bottom component, which interconnects the two side components. An opening is defined in the framework in vertical alignment with each leg so that exercise tables in accordance with the invention can be stacked on each other with the tapered legs of an overlying table passing through an associated opening of an underlying table and into closely adjacent relationship with the legs of the underlying table. In other words, the tables are allowed to nest and can be closely stacked with each other not only due to the tapered configuration of the legs which permits nesting but also the movable positioning of the foot bar, the shoulder blocks, and the pulleys.

Other aspects, features, and details of the present invention can be more completely understood by reference to the following detailed description of the preferred embodiment, taken in conjunction with the drawings and from the appended claims.

DESCRIPTION OF THE PREFERRED EMBODIMENT

Figure 1:
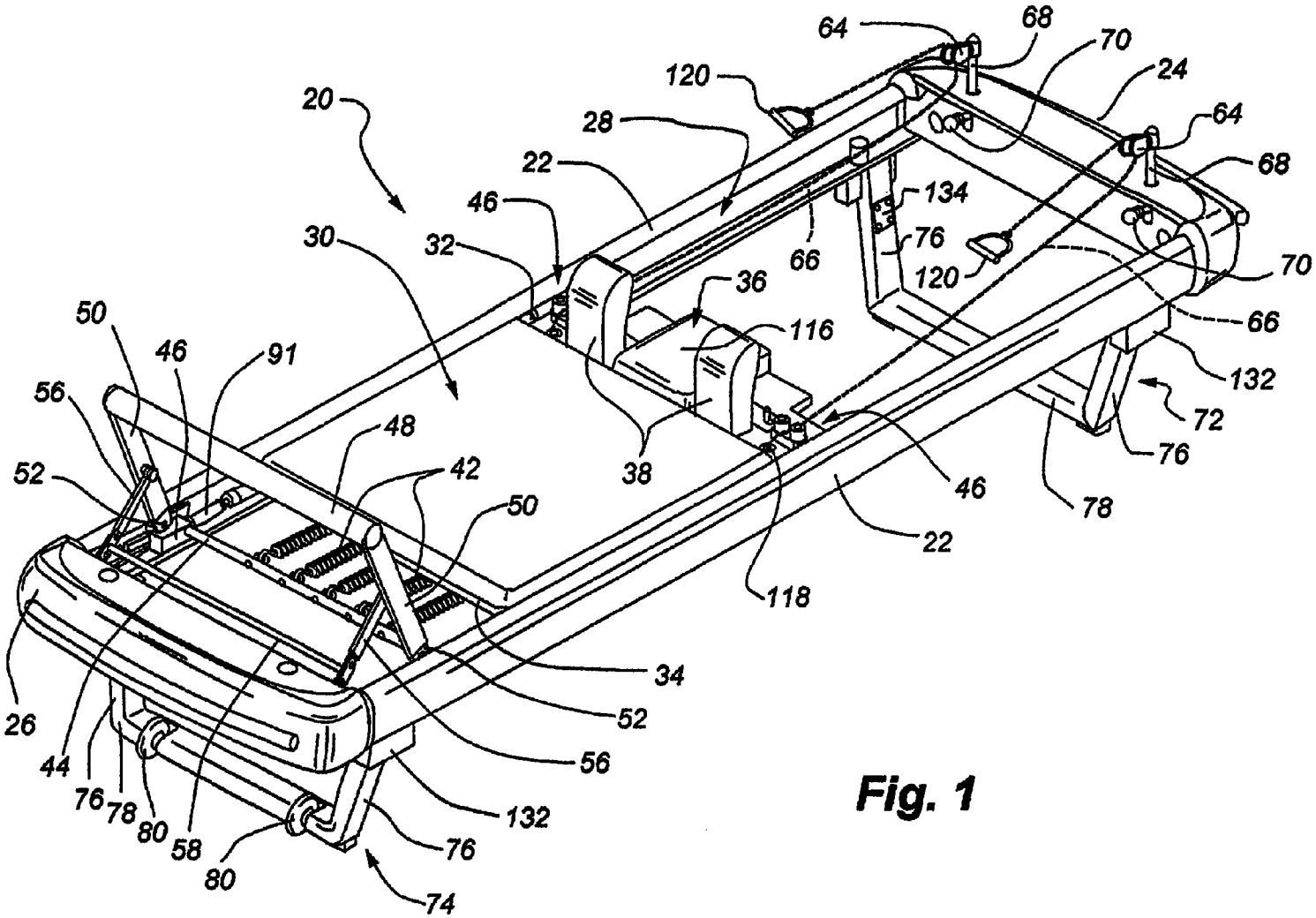
FIG. 1 is an isometric view of the exercise table of the present invention in a use position.
Figure 2:
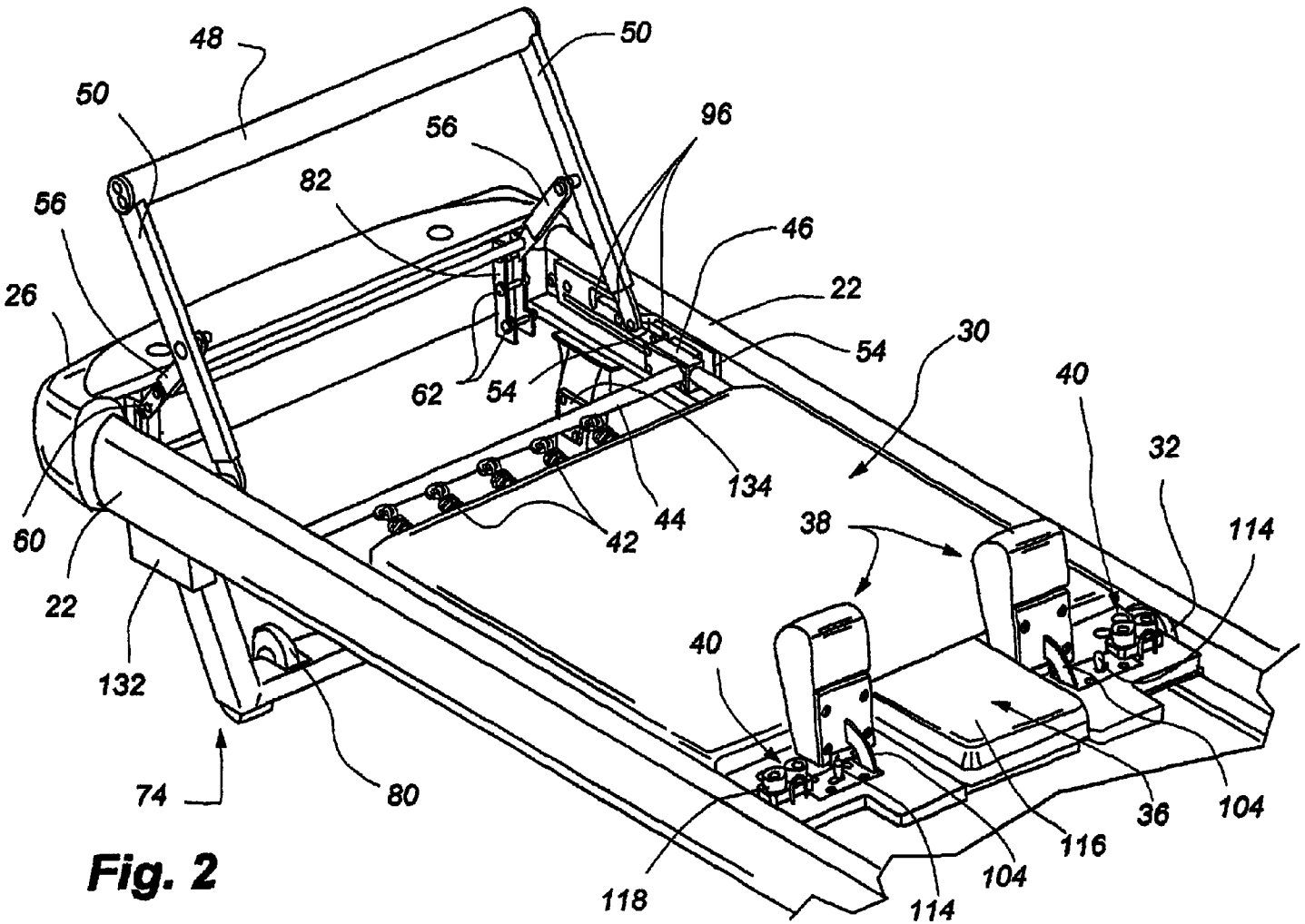
FIG. 2 is a fragmentary isometric similar to FIG. 1 looking from a different direction.

Referring first to FIG. 1, an exercise table 20 of the "Reformer" type is illustrated as having a peripheral frame with a pair of longitudinally extending side components 22, a head component 24 and a foot component 26. The side frame components have inwardly opening channels 28 which define tracks on which a support platform 30 is supported with rollers 32 (FIG. 2). The support platform includes a rigid structural panel 34 (FIG. 5) of generally rectangular configuration having a strength and size to substantially support the back of the user of the table. At the head end of the panel, a head support 36 is centrally positioned for supporting a user's head and on opposite sides of the head support are a pair of shoulder blocks 38 which are pivotally mounted in a manner and for a purpose to be described hereafter. Positioned adjacent to the shoulder blocks are conventional rope locks 40 on each side of the panel also for a purpose to be described hereafter. The panel 34 has anchored thereto one end of a plurality of coil springs 42 whose opposite ends are secured to an anchor rod 44 having its opposite ends secured to anchor blocks 46 slidably supported within the channels 28 of the side frame components. In this manner, it will be appreciated the support platform can be moved by rolling it along the side frame components toward the head end of the frame against the bias of the coil springs which will automatically return the platform toward the foot end when the counter bias force is released.

Figure 5:
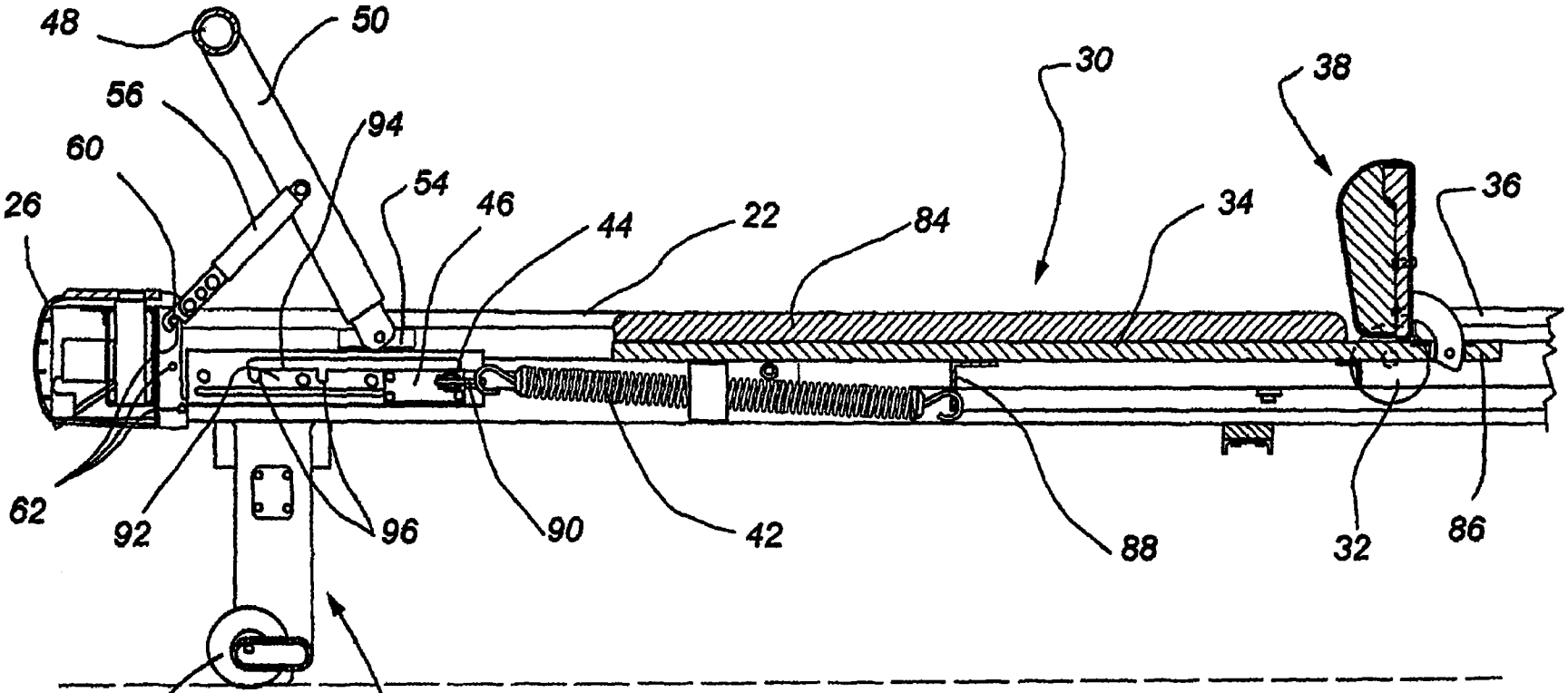
FIG. 5 is an enlarged fragmentary section taken along line 5-5 of FIG. 3.
Figure 6:
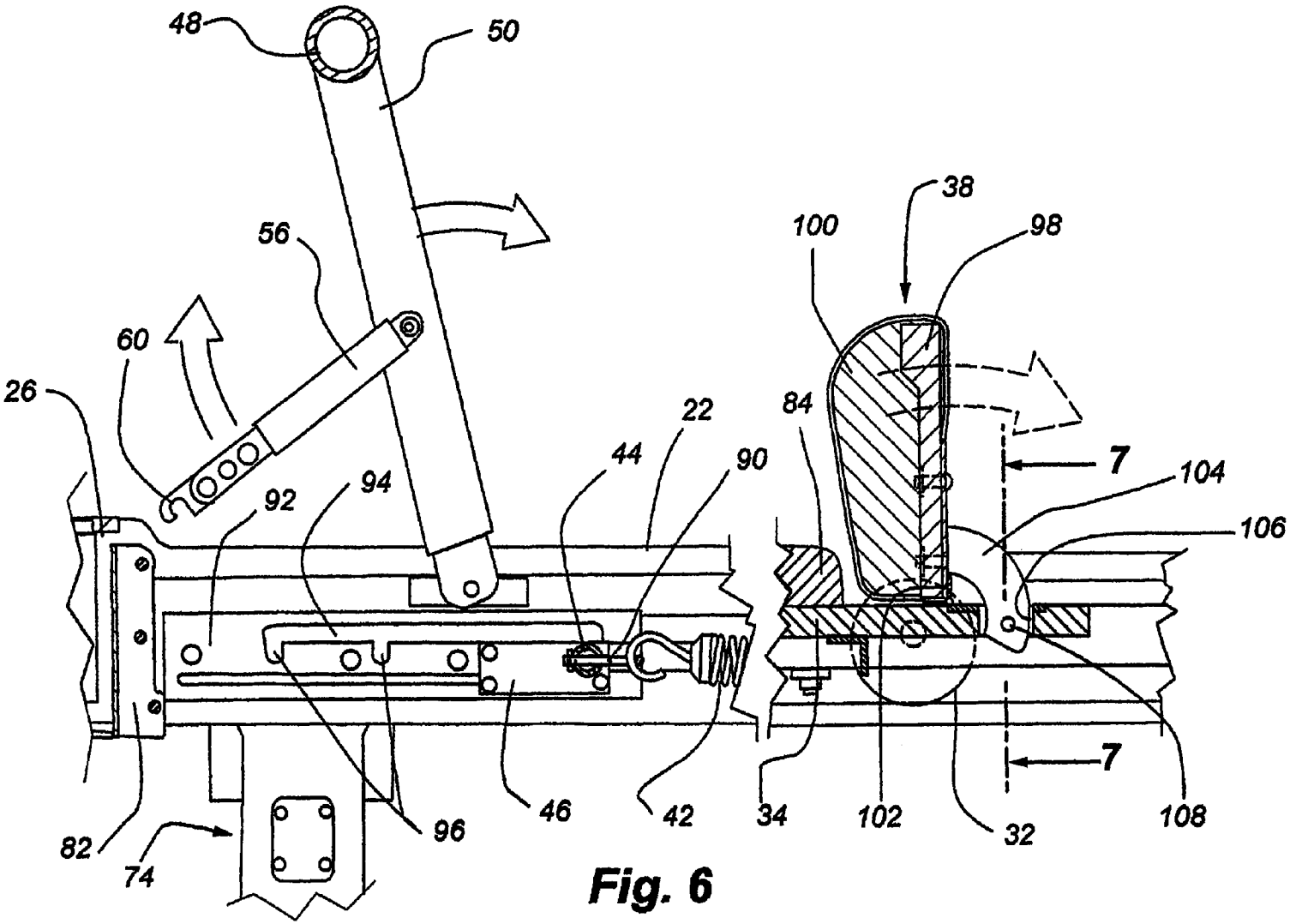
FIG. 6 is a fragmentary side elevation illustrating the pivotal movement of the foot bar and the shoulder blocks.
Figure 9:
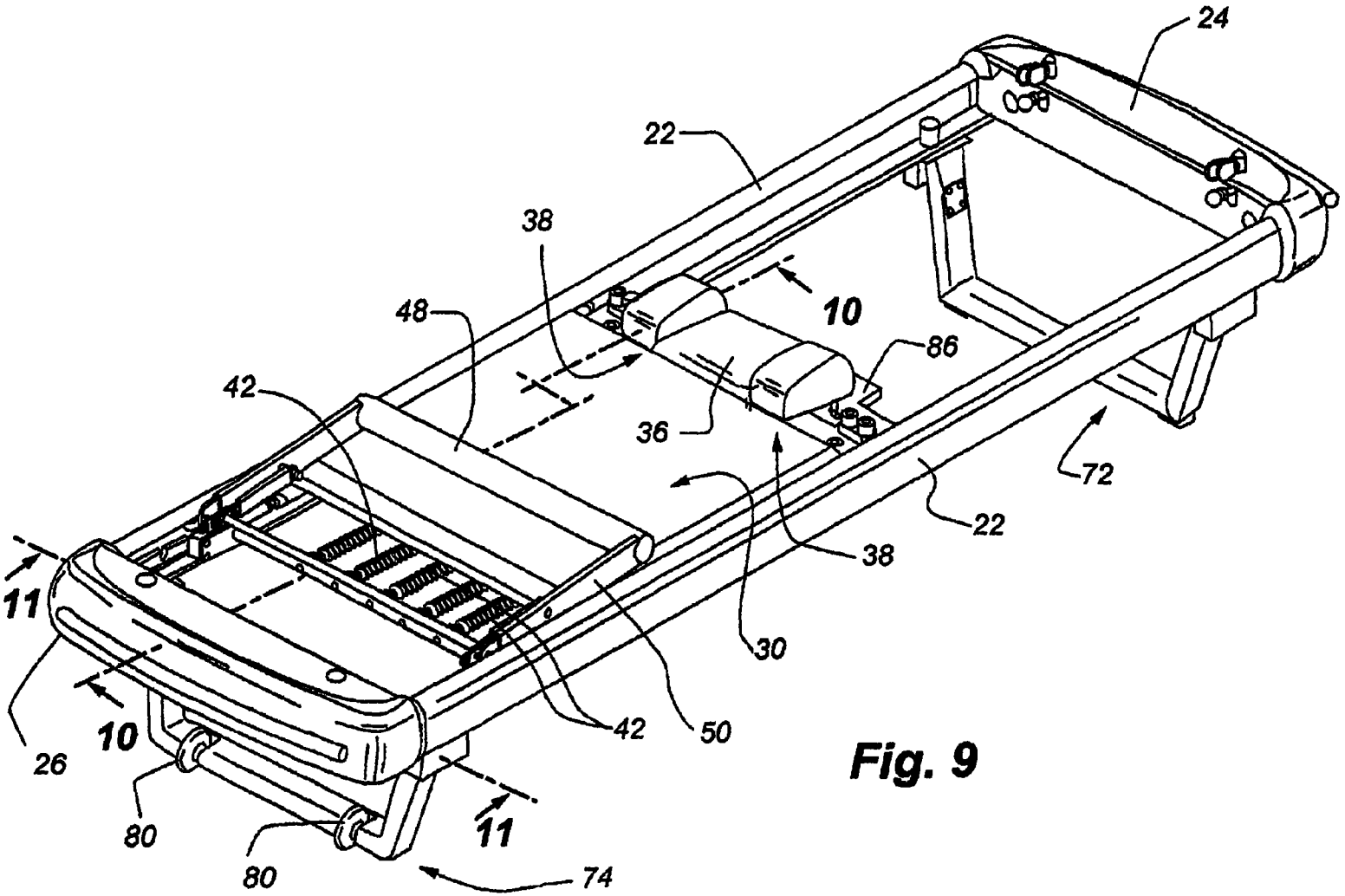
FIG. 9 is an isometric similar to FIG. 1 showing the foot bar, shoulder blocks, and pulleys in a lowered storage position.
Figure 10:
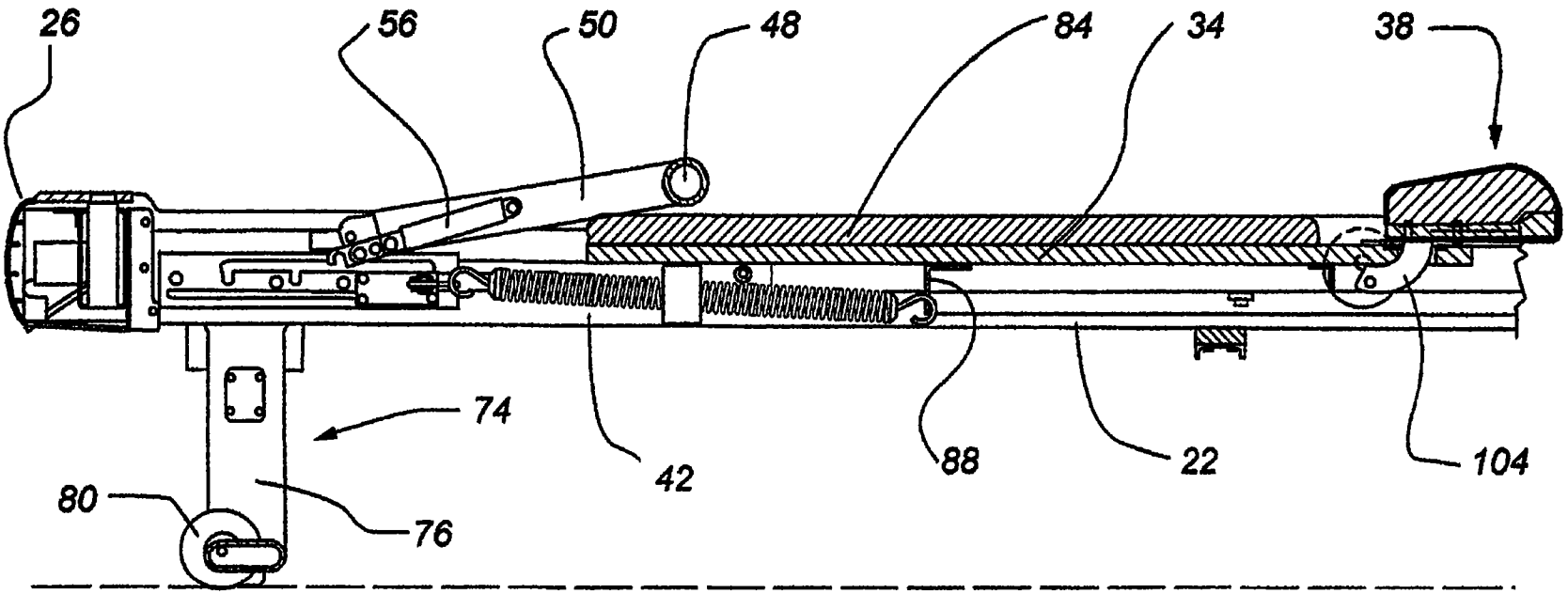
FIG. 10 is an enlarged section taken along line 10-10 of FIG. 9.
Figure 11:
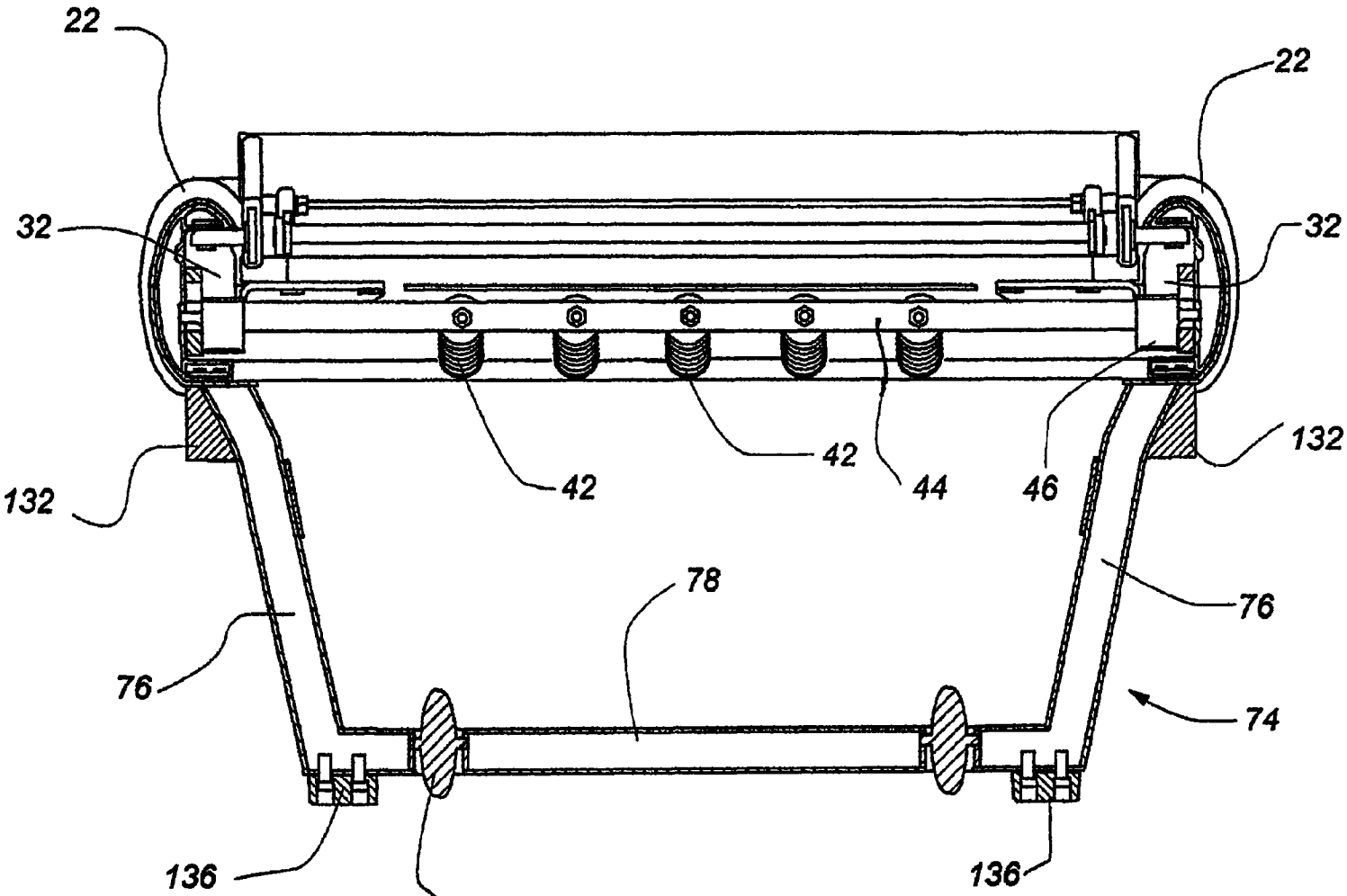
FIG. 11 is an enlarged section taken along line 11-11 of FIG. 9.

Near the foot end of the frame, a foot bar 48 is mounted on the end of a pair of parallel side links 50 whose lower ends are supported on pivot pins 52 (FIG. 1) secured to brackets 54 anchored to the side frame components 22. The foot bar and side links therefore define a generally inverted U-shaped structure which pivots about the pivot pins in selected ones of a plurality of use positions to be described hereafter and a storage position as shown for example in FIG. 9. Adjustment arms 56 are pivotally connected to the side links at an intermediate location along the length of each side link and have their lower ends interconnected by a support bar 58 with the lower end of each adjustment arm having a hook-shaped catch 60, as seen for example in FIG. 5, for releasable support on one of a plurality of vertically spaced support pins 62 anchored to the foot frame component 26 so the inclination of the side links and the spacing of the foot bar from the support platform 30 can be releasably adjusted. Further, the foot bar can be pivoted into the storage position of FIG. 9 by rotating the foot bar in a clockwise direction, as illustrated in FIG. 6, until it rests on the support platform as shown in FIG. 9.

Figure 5B:
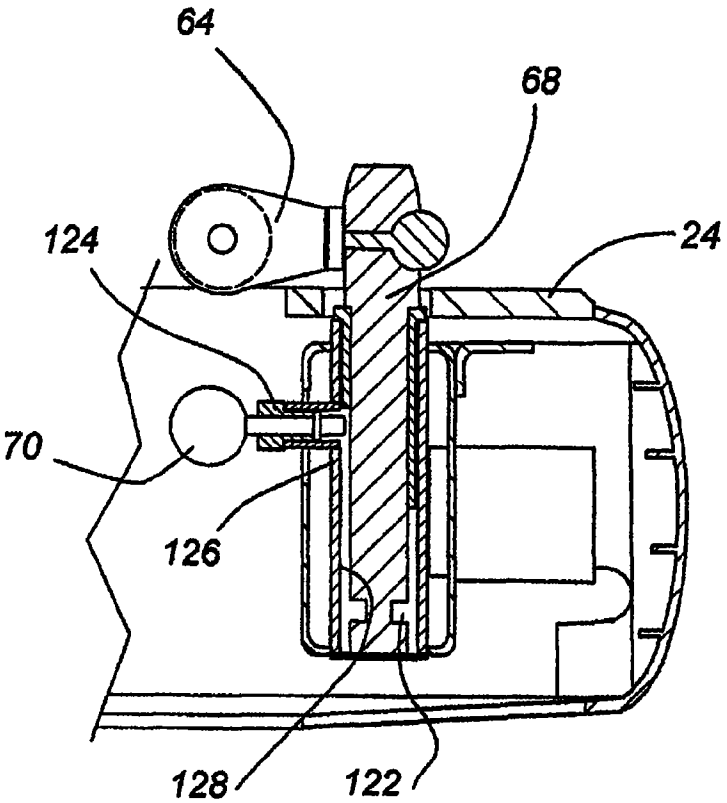
FIG. 5B is a section similar to FIG. 5A showing the pulleys in a lowered position.

In the head component 24 of the frame, a pair of vertically adjustable pulleys 64 are mounted for cooperation with flexible ropes 66 (FIG. 1) with the pulleys each being mounted on a vertical post 68 that is movable between an elevated use position, as shown in FIG. 1, and a lowered storage position as shown in FIG. 5B. The pulleys can be locked in their use position with a lock pin 70 in a manner to be described hereafter and will remain in the storage position by gravity.

A head support leg 72 and a foot support leg 74 are secured to and depend downwardly from the side frame components 22 near the head and foot of the frame with each leg having inwardly and downwardly tapered side elements 76, the upper ends of which are anchored to an associated side frame component, and an interconnecting lower element 78 so the support legs are generally trapezoidal in configuration. The support leg 74 at the foot end of the exercise table has a pair of rollers 80 rotatably mounted thereon so the table can be easily rolled between desired locations by lifting the head end of the table and rolling the table along a support surface with the rollers.

As will be appreciated with the more detailed description of the exercise table hereafter, since various components of the exercise table are movable between use and storage positions and the support legs are tapered and vertically aligned with openings through the frame, the tables can be nestably stacked with identical tables to save on storage space.

Looking more particularly at the foot end component 26 of the frame, as probably best seen in FIG. 2, it can be seen to be a substantially hollow generally U-shaped component having openings at opposite ends for frictional receipt of the side components 22 of the frame so the foot end component establishes an end cap at the foot end of the frame, which could also be mechanically secured. Within the foot end component, a pair of brackets 82 (FIGS. 2 and 6) are disposed adjacent each end with the brackets supporting the three horizontally disposed but vertically displaced support pins 62 which are adapted to releasably receive the hook-shaped catch 60 of an adjustment arm 56. As mentioned previously, the hook or catch on the end of the adjustment arms can thereby be releasably positioned on any one of the three support pins thereby selectively and temporarily positioning the location of the foot bar 48 at different elevations and spacings from the support platform 30 due to the pivotal mounting of the foot bar. Of course, when the hook-shaped ends of the adjustment arms are completely released from a support pin, the foot bar can be pivoted in a clockwise direction as shown in FIG. 6 until the foot rod rests upon the support platform in the storage position of the foot bar.

The support platform 30 itself is possibly best understood by reference to FIG. 5 where it can be seen to include the generally rectangularly shaped rigid panel 34 upon which is disposed a padded cover 84 on the foot end thereof on which a user of the exercise table 20 can position his or her body. The panel extends beyond the pad toward the head end of the frame so as to define a ledge 86 on which the head support 36 and the shoulder blocks 38 are mounted along with the rope locks 40. An L-shaped bracket or bar 88 is transversely supported underneath the panel 34 and defines an anchor for one end of the coil springs 42 with the opposite end of the coil springs being connected to anchor loops 90 on the transverse anchor rod 44, which as previously noted is secured at its opposite ends in anchor blocks 46 slidably positioned within the side components 22 of the frame. Shock absorbers 91 (FIG. 1) are secured to the foot end of the support platform to cushion contact of the support platform with the sliding blocks 46 and also establish a uniform spacing between the support platform and the anchor bar 44 when the support platform is fully retracted as shown in FIG. 1. In this manner, it will be appreciated the support platform is biased toward the foot end of the frame by the coil springs and the panel itself is supported for rolling movement along the side frame components by rollers 32 at each end and on each side of the panel with only a roller at the head end of the panel being shown for example in FIGS. 5 and 6. Horizontal rollers (not seen) for guiding the rolling movement of the support platform are also provided for engagement with vertical walls of the side components 22.

The anchor blocks 46 are slidably mounted (FIG. 5) on a grooved plate 92 in each side frame component 22 with the groove having a longitudinally extending element 94 and four downwardly extending notches 96, for example, in FIGS. 5 and 6. A slide pin on the outside of the anchor blocks (not shown) is received within the groove so it can slide along the longitudinal element 94 of the groove and be releasably and selectively positioned in any one of the four downturned notches 96. In FIGS. 5 and 6, the slide pin is positioned within the notch closest to the head end of the frame even though, as mentioned, it can be positioned in any of the four notches, which adjusts the position of the foot end of the coil springs 42 so the device can accommodate individuals of different heights. In other words, a shorter individual would probably position the anchor blocks 46 in the notch closest to the foot end of the frame, while a taller individual might position the anchor blocks as illustrated in FIGS. 5 and 6 where the support platform 30 is spaced a greater distance from the foot bar 48.

Figure 8:
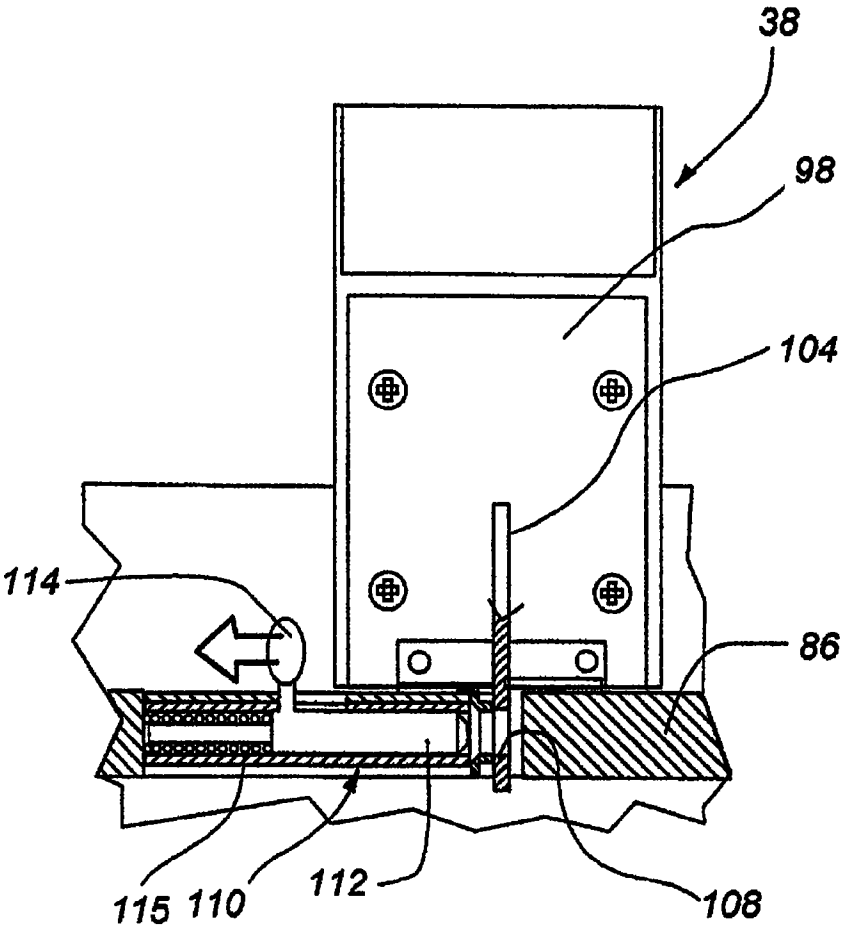
FIG. 8 is a section similar to FIG. 7 illustrating the lock pin for the shoulder blocks in a retracted position.
Figure 7:
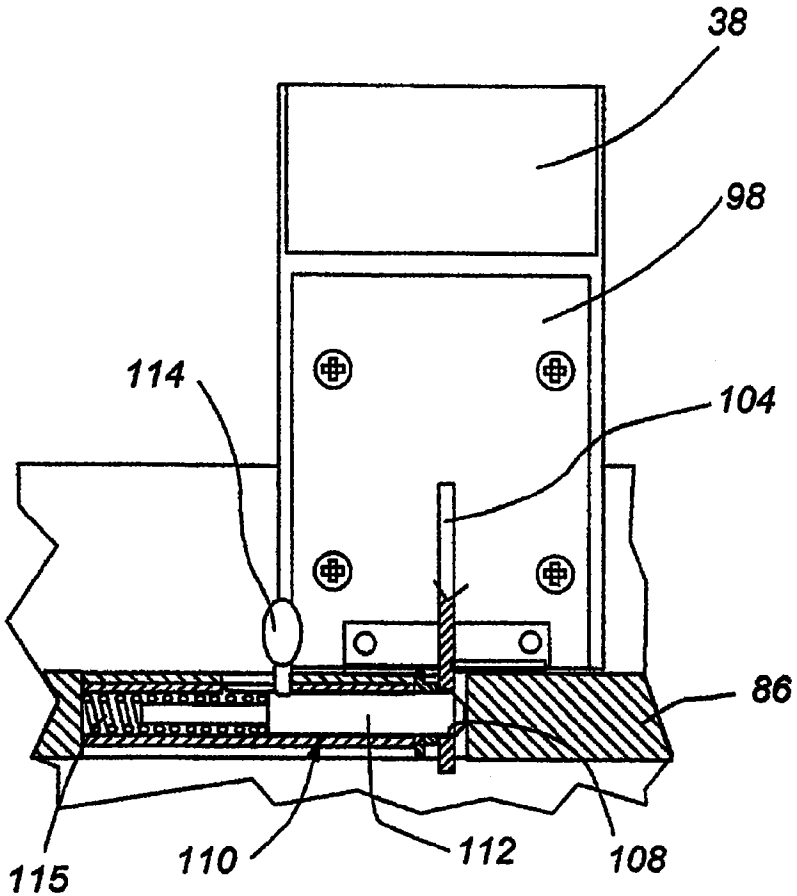
FIG. 7 is an enlarged section taken along line 7-7 of FIG. 6.

With reference to FIGS. 6, 7, and 8, each shoulder block 38 can be seen to include a rigid backing plate 98 on which a pad 100 is mounted and covered. The pad of course faces the foot end of the table so as to engage a user's shoulders when the user is lying on the support platform 30 on his or her back and with his or her feet resting on the foot bar. As mentioned previously, the shoulder blocks are pivotal between a use position as illustrated in FIGS. 6-8, and a storage position as seen in FIG. 9. Each shoulder block has its rigid plate secured along a lower edge to a hinge 102 that is also secured to the panel 34 of the support platform, and each shoulder block includes an arcuate guide 104 which is secured to the rigid plate 98 of the associated shoulder block and extends through a slotted opening 106 provided in the panel of the support platform. The arcuate guide has a transverse hole 108 through a lower end thereof, which selectively and releasably receives a lock pin 110 (FIGS. 7 and 8). The lock pin is slidably and transversely mounted within the panel as probably best illustrated in FIGS. 7 and 8. It will there be seen that the lock pin has a cylindrical shaft 112 and a handle 114 radially disposed thereon with the handle projecting above the panel for access by a user. The handle can slide the lock pin axially between a locking position shown in FIG. 7 and a release position as shown in FIG. 8. When it is desired to elevate the shoulder blocks so they are useful in operation of the exercise table, the shoulder block can be pivoted into its raised use position and then the lock pin is biased by a spring 115 to the locking position of FIG. 7 so the pin snaps into the hole 108 in the arcuate guide and thereby retains the shoulder block in the elevated use position. Of course, for storage purposes, the lock pins are used to release the associated shoulder blocks so they can be pivoted downwardly into the storage position of FIG. 9 where they remain by gravity.

The head support 36 (FIGS. 1 and 2) also has a rigid back plate, which is not seen, and a pad 116 mounted on the upper surface thereof and is secured to the panel 34 of the support platform 30 in any suitable manner.

The rope locks 40 (FIGS. 1 and 2) disposed adjacent to the pivotal shoulder blocks 38 are conventional rope lock items having two slightly spaced eccentric cams which are rotatable about vertical axes and cooperate with ropes, cords, or the like in securing the ropes 66 to the rope lock at a desired position along the length of the rope. Such rope locks are commonly used on sailboats or the like. The ropes 66 with which the rope locks cooperate are shown only in FIG. 1 and are passed upwardly through a hole 118 in the panel 34 adjacent a rope lock with one free end of the rope hanging beneath the platform. The other end of the rope is extended through the rope lock, where it can be gripped at any location along its length, then to the head end of the frame where it passes around an associated pulley 64 and returned loosely toward the support platform 30. The end of the rope returned toward the support platform has a handle 120 for gripping by a user. In this manner, a user positioned on the platform can reciprocate the platform by engaging the foot bar 48 with his or her feet while extending and retracting his/her legs and/or pull and release the ropes 66 to effect the same movement.

Figure 5A:
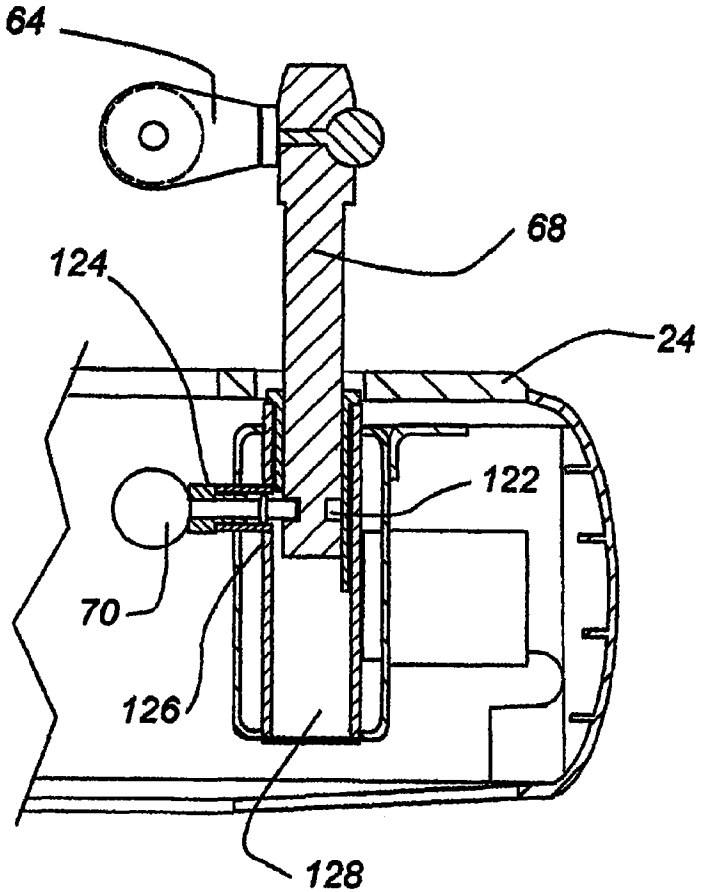
FIG. 5A is an enlarged fragmentary section taken along line 5A-5A of FIG. 3 showing the pulleys of the head end component of the frame in an elevated position.

It is probably best appreciated by reference to FIGS. 5A and 5B, the pulleys 64 at the head end of the frame, as previously mentioned, have vertical support posts 68 which are movable between the elevated position shown in FIG. 5A and a lowered position shown in FIG. 5B. The elevated position, of course, is used when the device is in use so the pulley is free to receive the previously discussed rope 66 and the lowered position of FIG. 5B is used when the table is being stored and stacked on similar tables.

Each support post 68 is generally cylindrical in configuration with the pulley 64 being anchored at the top of the post in a laterally projecting direction toward the foot end of the exercise table in any suitable manner. The lower end of the support post has a circumferential groove 122 formed therein with the groove adapted to cooperate with the lock pin 70 that is mounted within a horizontally disposed cylindrical neck 124 on a receiving cylinder 126 having a vertically extending cylindrical recess 128 for slidably receiving the support post. The lock pin can therefore be moved between a locking position of FIG. 5A and a release position of FIG. 5B so that in the release position, the support post can be moved upwardly or downwardly within the recess. In the raised position of FIG. 5A, the lock pin can be advanced into the circumferential groove 122 to hold the post in an elevated use position but with the lock pin released, the post can be lowered into the storage position of FIG. 5B where it remains by gravity and friction.

Figure 3:
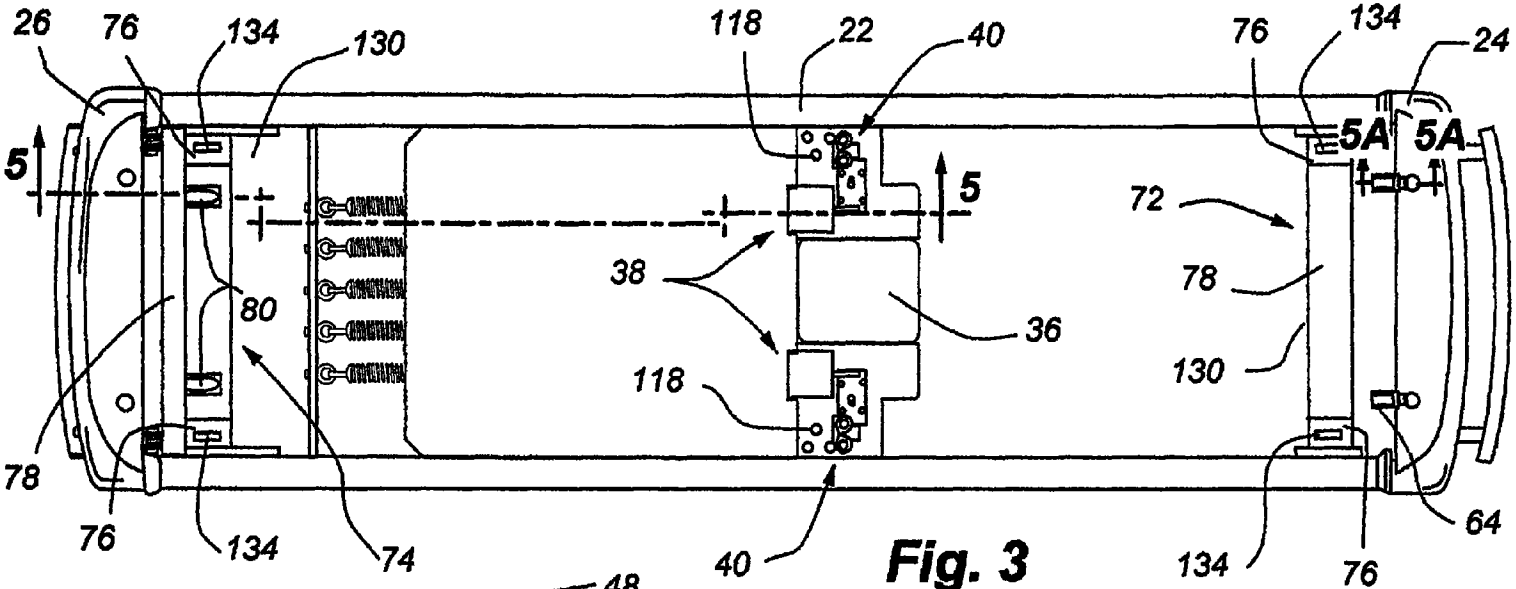
FIG. 3 is a top plan view of the exercise table as shown in FIG. 1.
Figure 4:
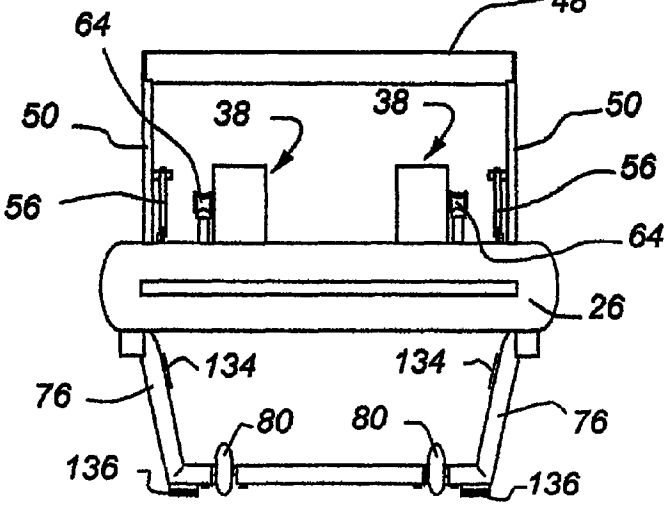
FIG. 4 is a front-end elevation of the table of FIG. 3.
Figure 12:
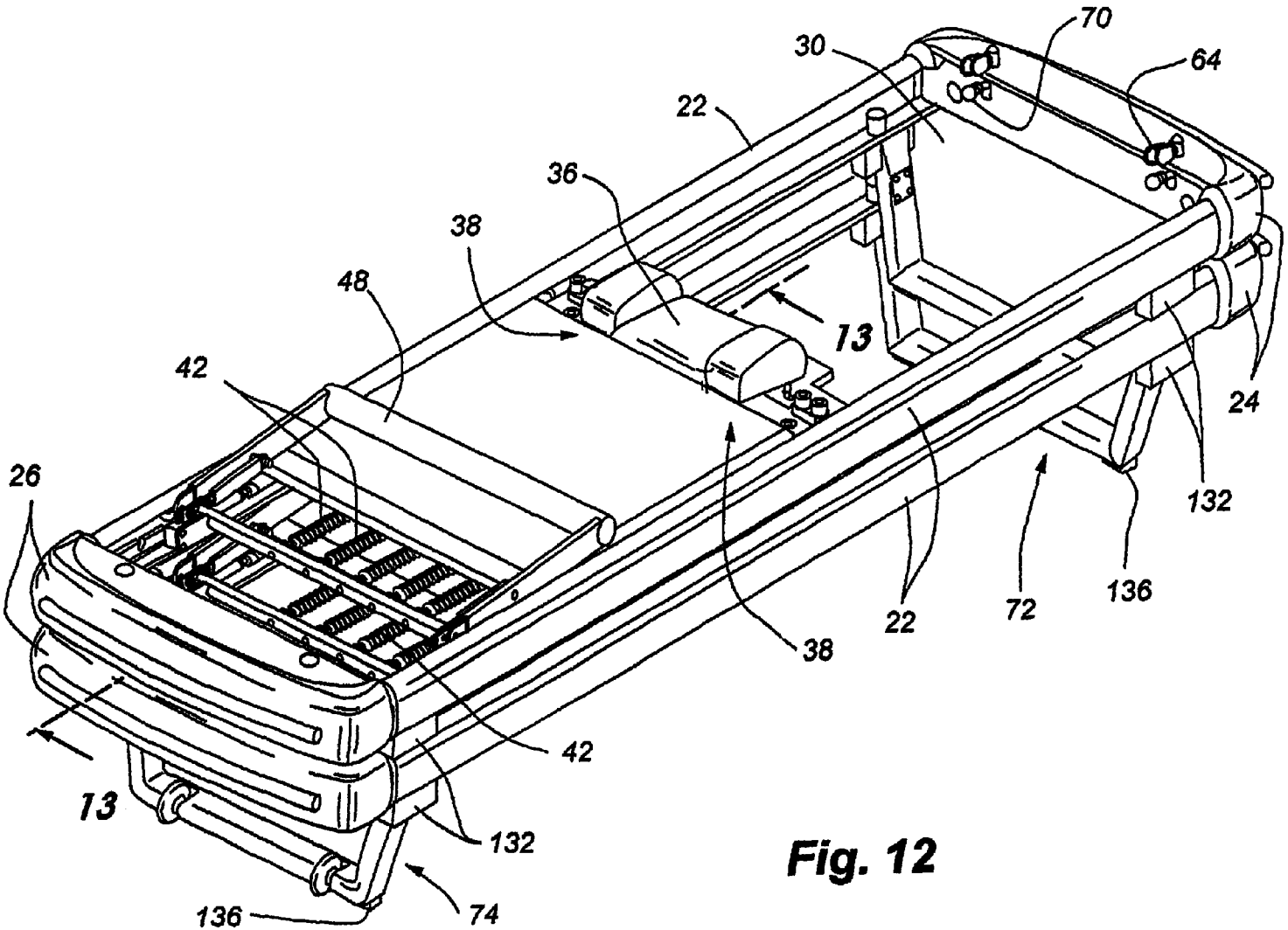
FIG. 12 is an isometric similar to FIG. 9 showing two identical exercise tables in nestably stacked relationship.
Figure 13:
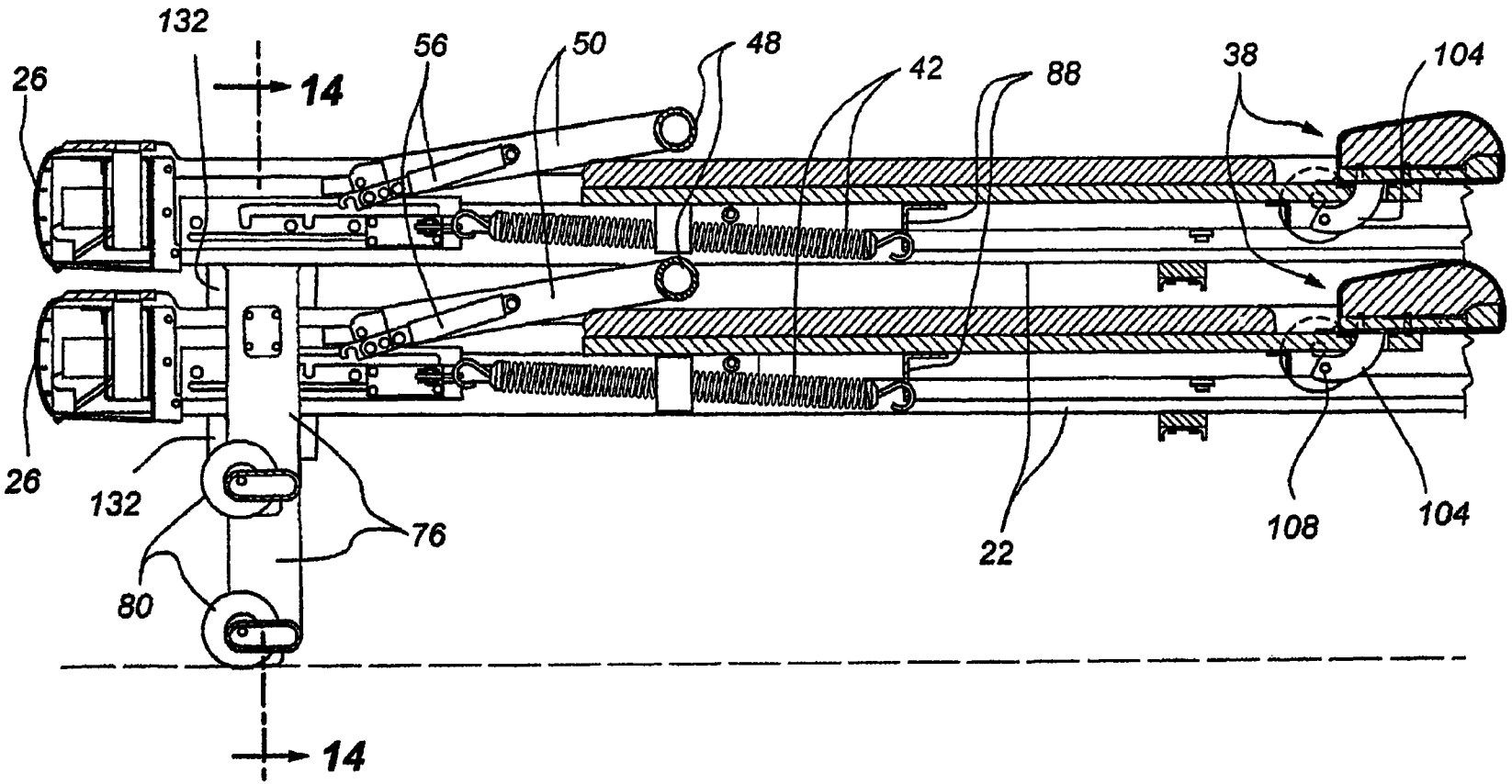
FIG. 13 is an enlarged fragmentary section taken along line 13-13 of FIG. 12.
Figure 14:
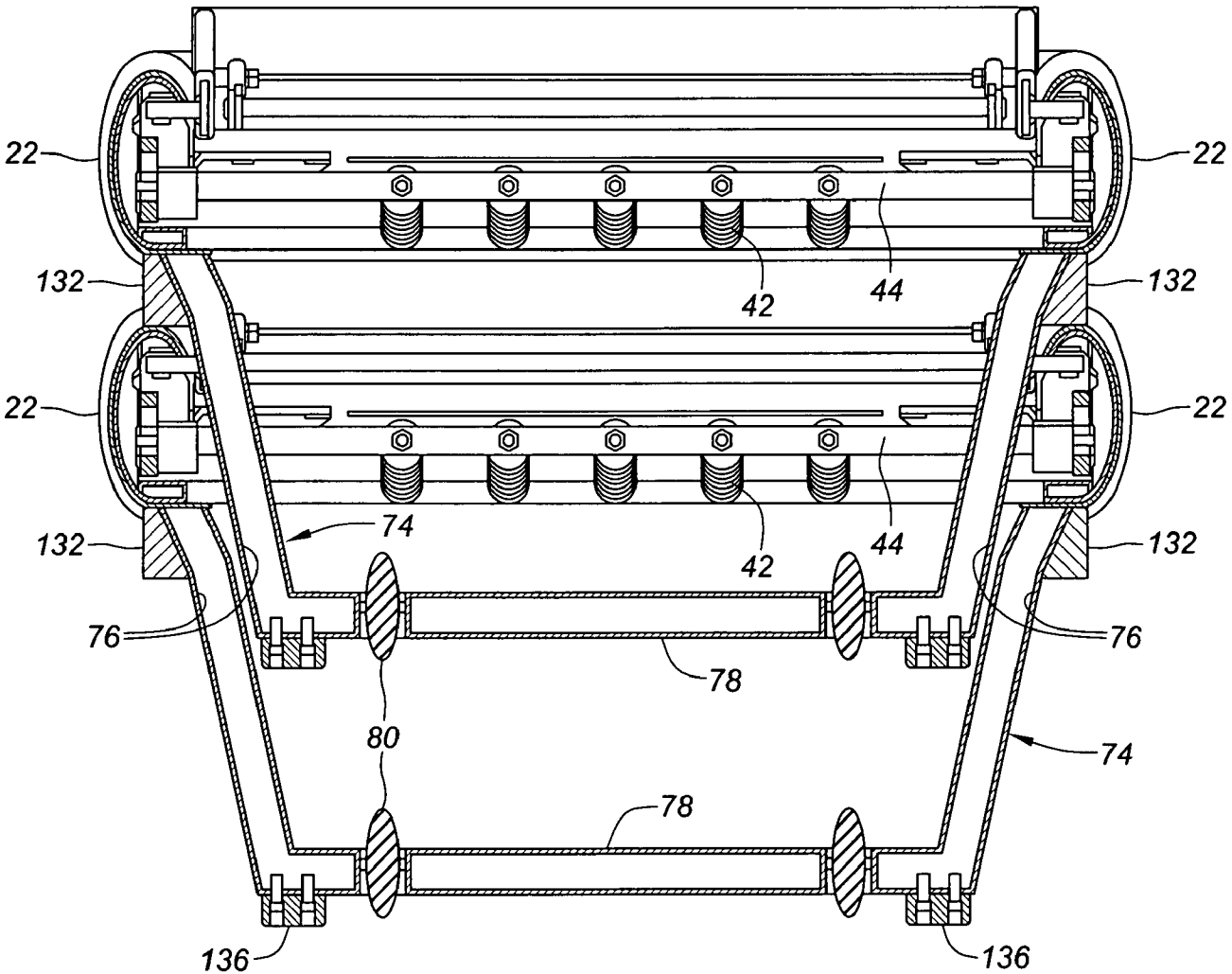
FIG. 14 is an enlarged section taken along line 14-14 of FIG. 13.

As possibly best appreciated by reference to FIG. 3, the frame defines an open space 130 vertically above each support leg 72 and 74 so that identical exercise tables can be stacked on each other as seen in FIGS. 12-14 by inserting the legs of an overlying exercise table through the open space above the support legs of an underlying table until four support pads 132 (FIGS. 1, 2, and 11-14) on the underside of the side frame components 22 at opposite ends thereof abut the top surface of the side frame component of the underlying exercise table. In this same position, centering pads 134 on the inner surface of the tapered side elements 76 of the legs of the underlying exercise table guide an outer surface of the tapered side elements of the legs of the overlying exercise table as best appreciated by reference to FIG. 14 when tables are being stacked. As also appreciated in FIG. 14, the legs can have support feet 136 secured thereto if desired. As previously mentioned, and as clearly illustrated in FIG. 14, the leg 74 at the foot end of the frame has the rollers 80 which are rotatably mounted so the exercise table can be moved from one location to another by elevating the head end of the frame and rolling the frame on a support surface with the rollers.

As can be appreciated by reference to FIGS. 12-14, when one exercise table is nestably stacked in another, they are in closely adjacent relationship partially due to the fact that the support legs 72 and 74 are nestable and also due to the fact that the foot bar 48, shoulder blocks 38, and pulleys 64 can be lowered into storage positions that are very close to the top surface of the frame. In fact, the foot bar, shoulder blocks, and pulleys only extend above the horizontal plane of the frame by a distance which corresponds with the height of the support pads 132 on which one frame rests on another frame. It will also be appreciated that when the tables are nestably stacked they occupy far less space than if they could not be nestably stacked and, accordingly, a significant number of the exercise tables can be stored in a health club or the like in a relatively small space.

Figure 15:
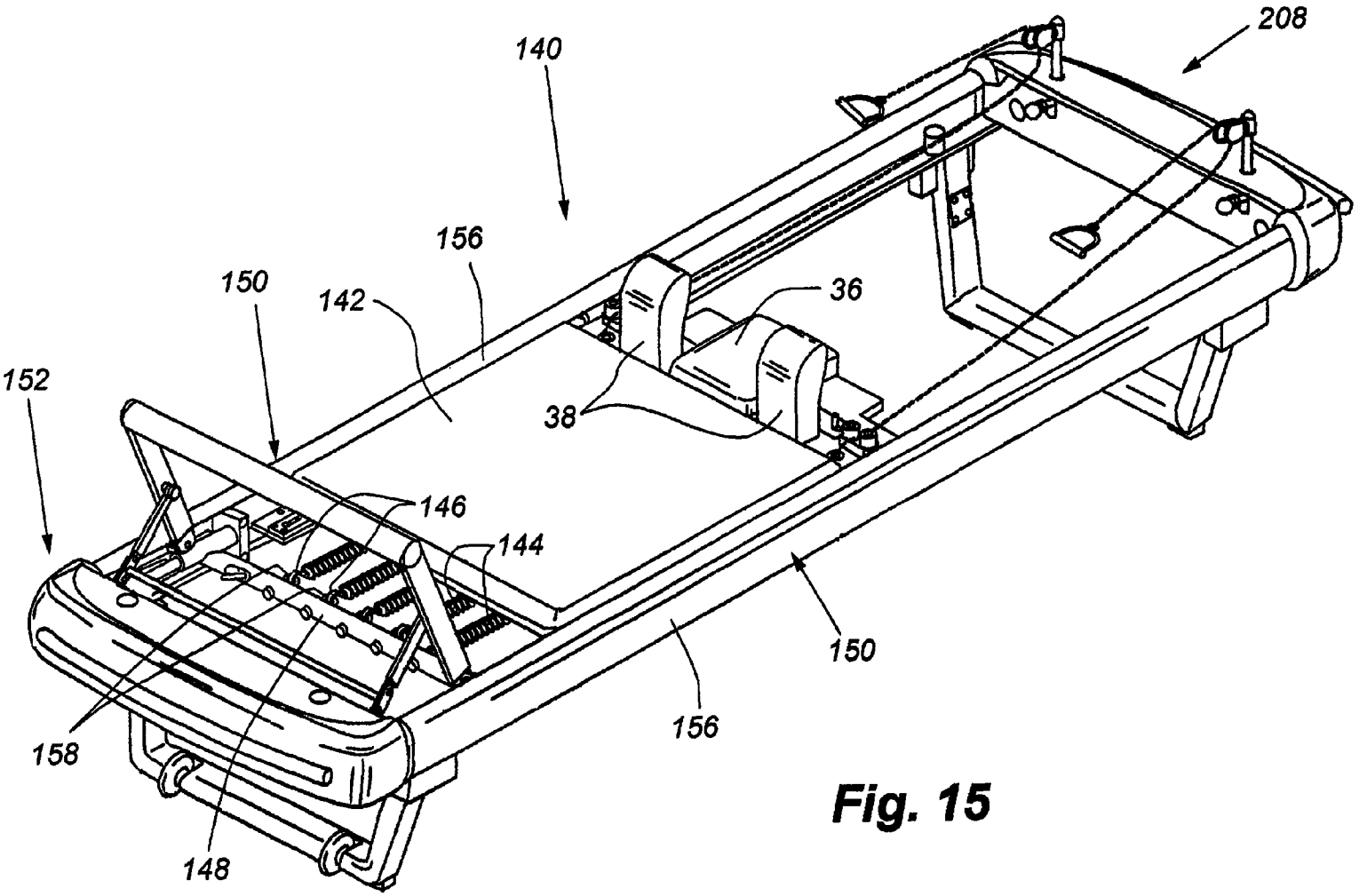
FIG. 15 is an isometric of a further embodiment of the exercise table of the present invention showing a different system for adjusting the anchor bar.
Figure 16:
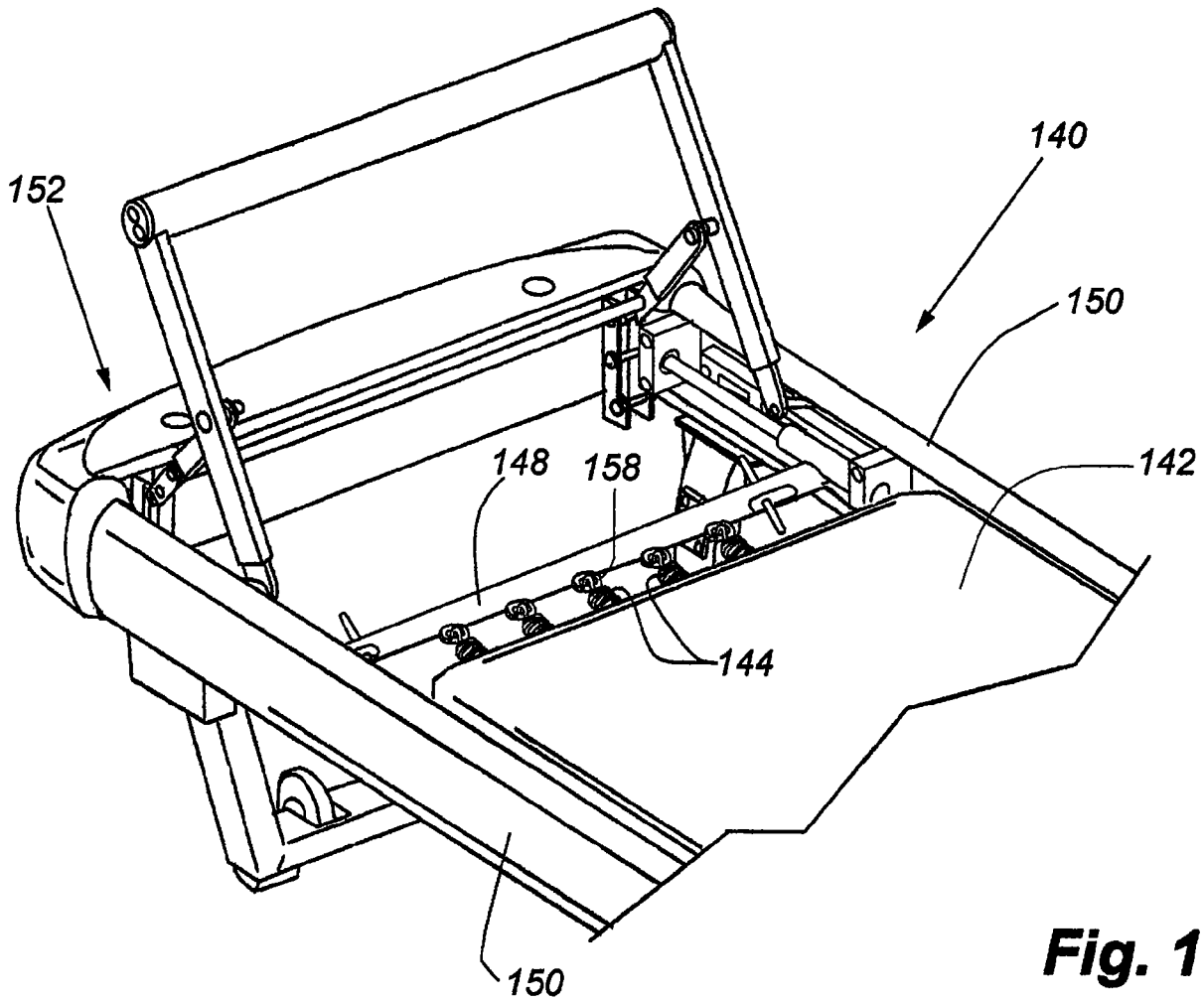
FIG. 16 is an enlarged fragmentary view of the foot end of the table shown in FIG. 15.
Figure 17:
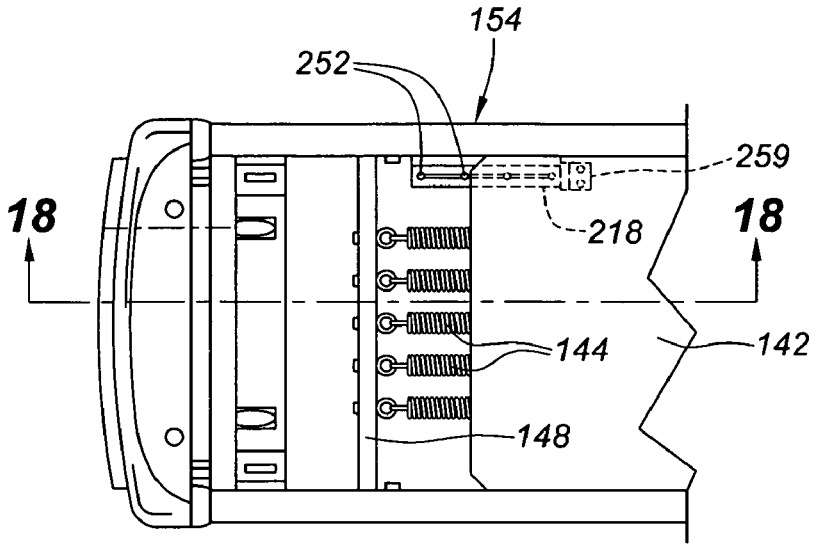
FIG. 17 is a fragmentary plan view of the foot end of the table of FIG. 15.
Figure 18:
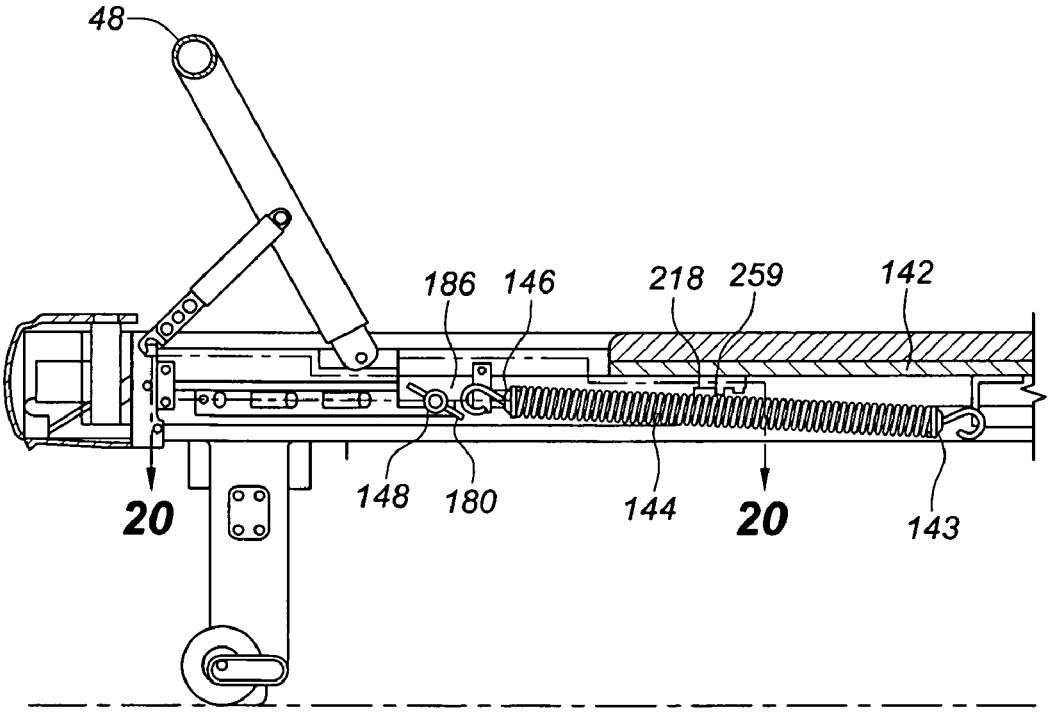
FIG. 18 is an enlarged fragmentary section taken along line 18-18 of FIG. 17.
Figure 19:
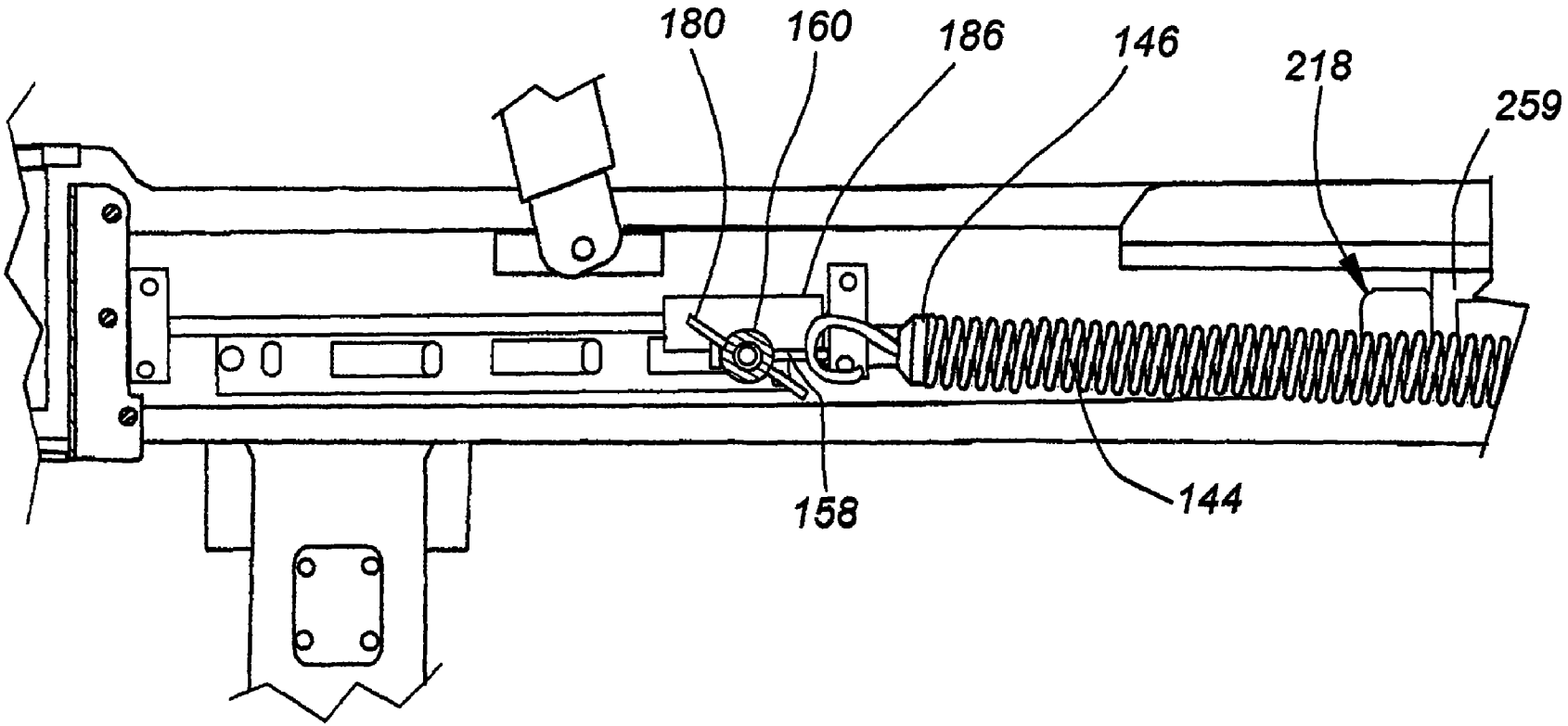
FIG. 19 is an enlarged fragmentary section showing some of the components shown in FIG. 18.
Figure 20:
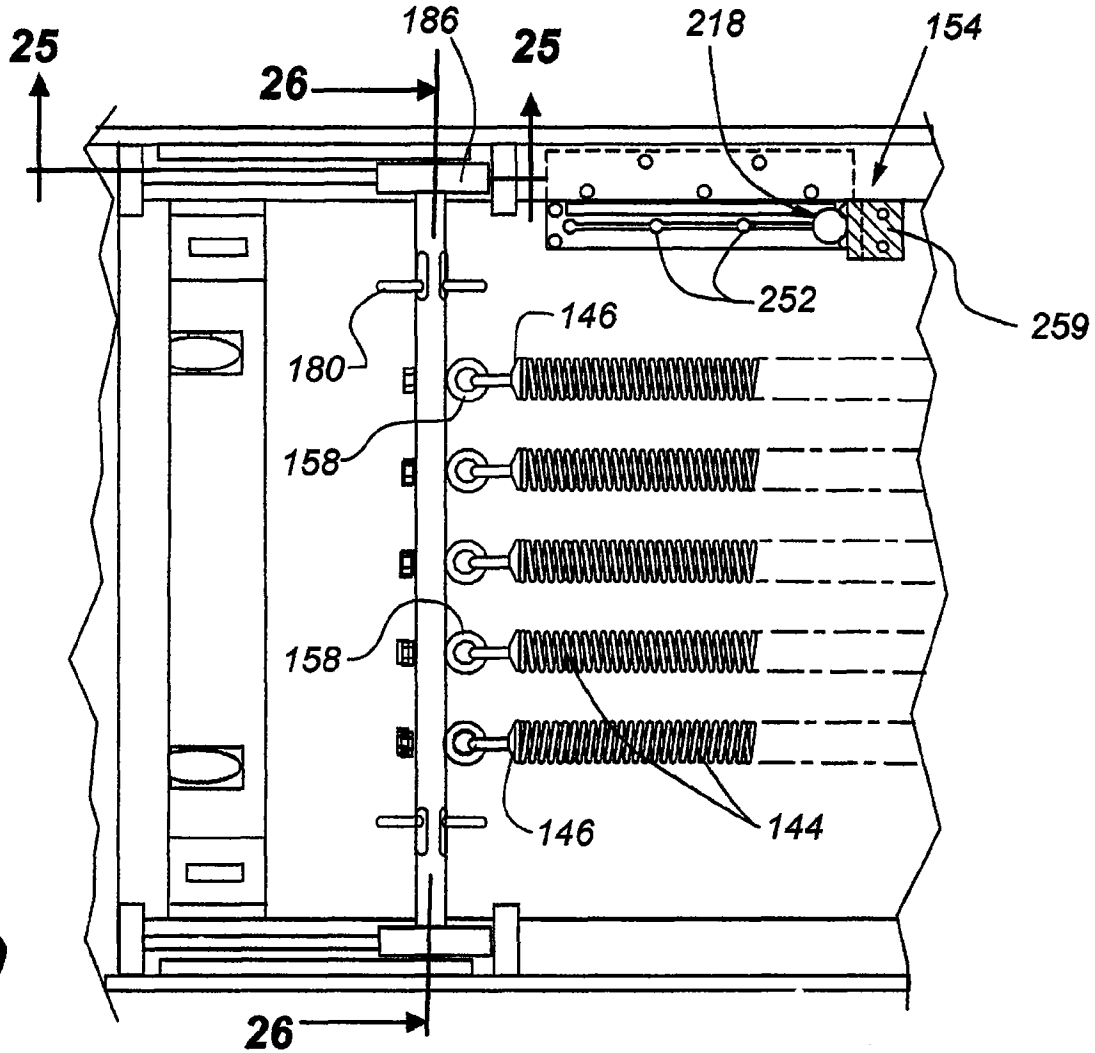
FIG. 20 is a fragmentary section taken along line 20-20 of FIG. 18.
Figure 21:
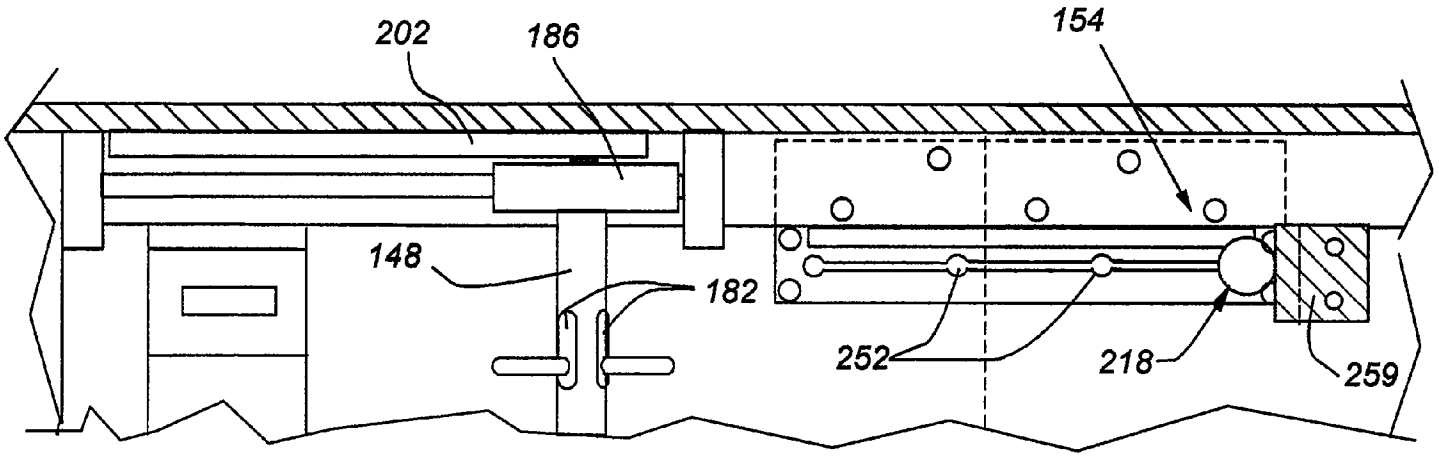
FIG. 21 is a fragmentary top plan view showing the adjustment system for the anchor bar and support platform for the table of FIG. 15.
Figure 22:
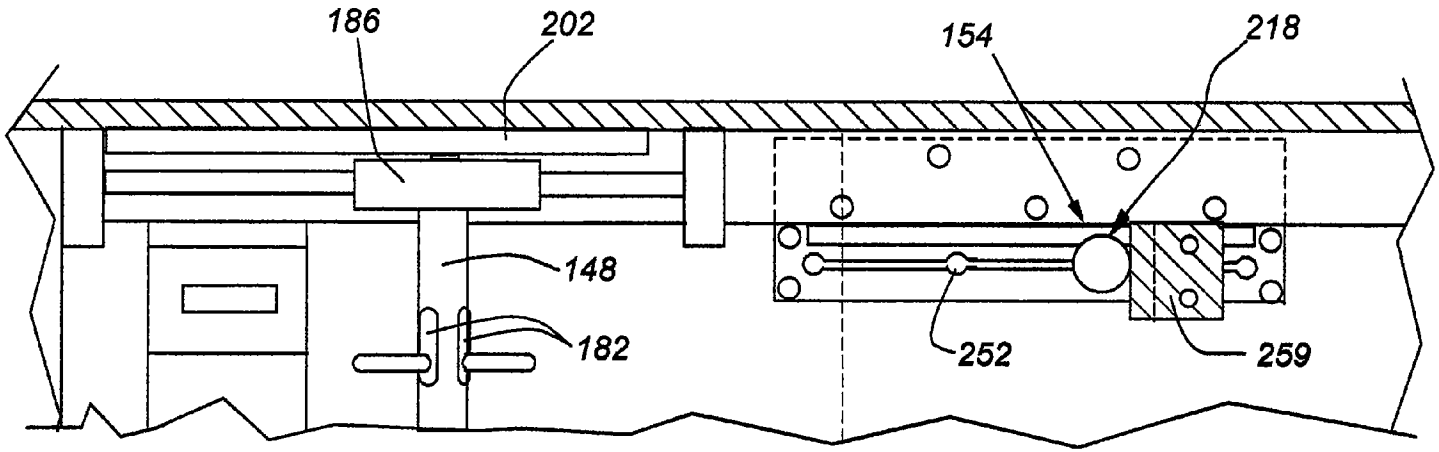
FIG. 22 is a fragmentary top plan view similar to FIG. 21, showing the adjustment in a different position.
Figure 23:
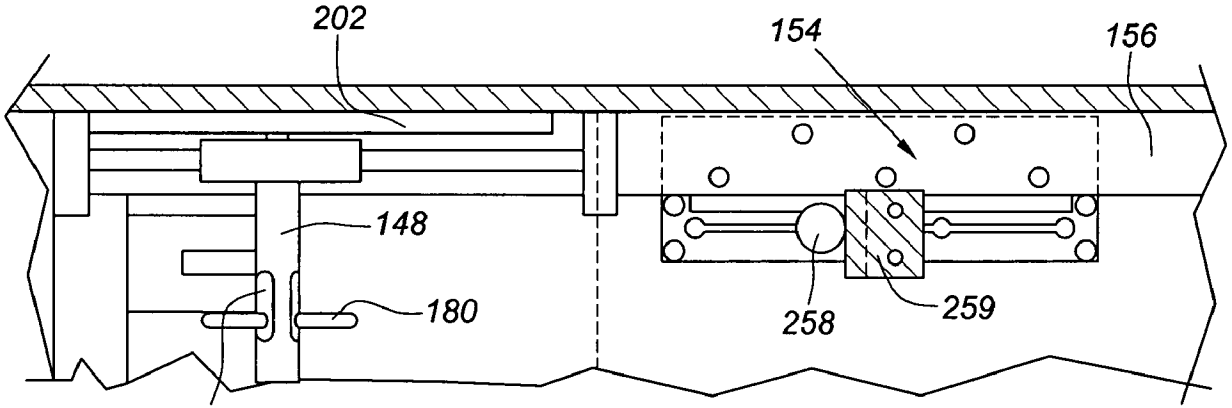
FIG. 23 is a fragmentary top plan view similar to FIG. 22 with the adjustment in still a further position.
Figure 24:
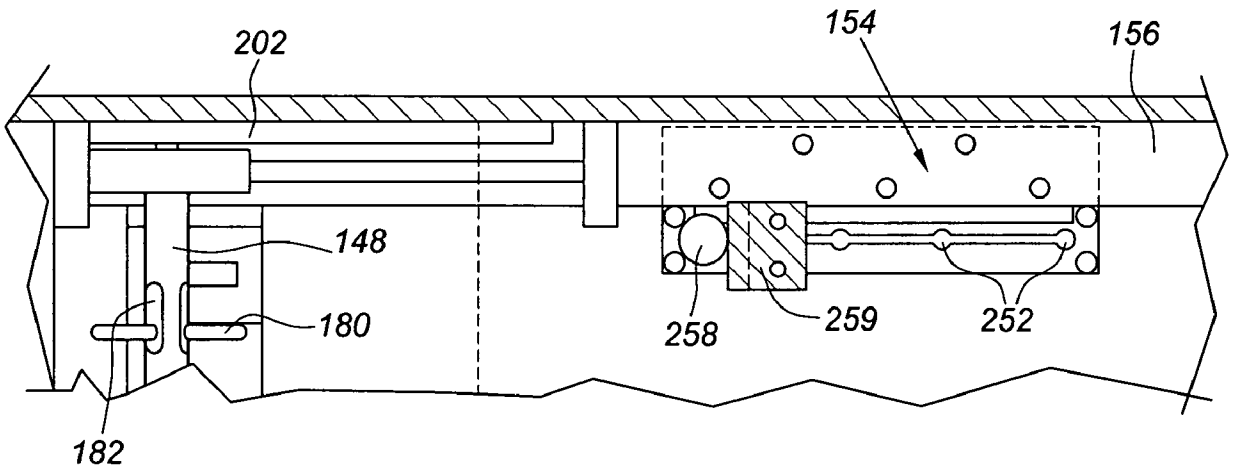
FIG. 24 is a fragmentary top plan view similar to FIG. 23 with the adjustment in still another position.
Figure 25:
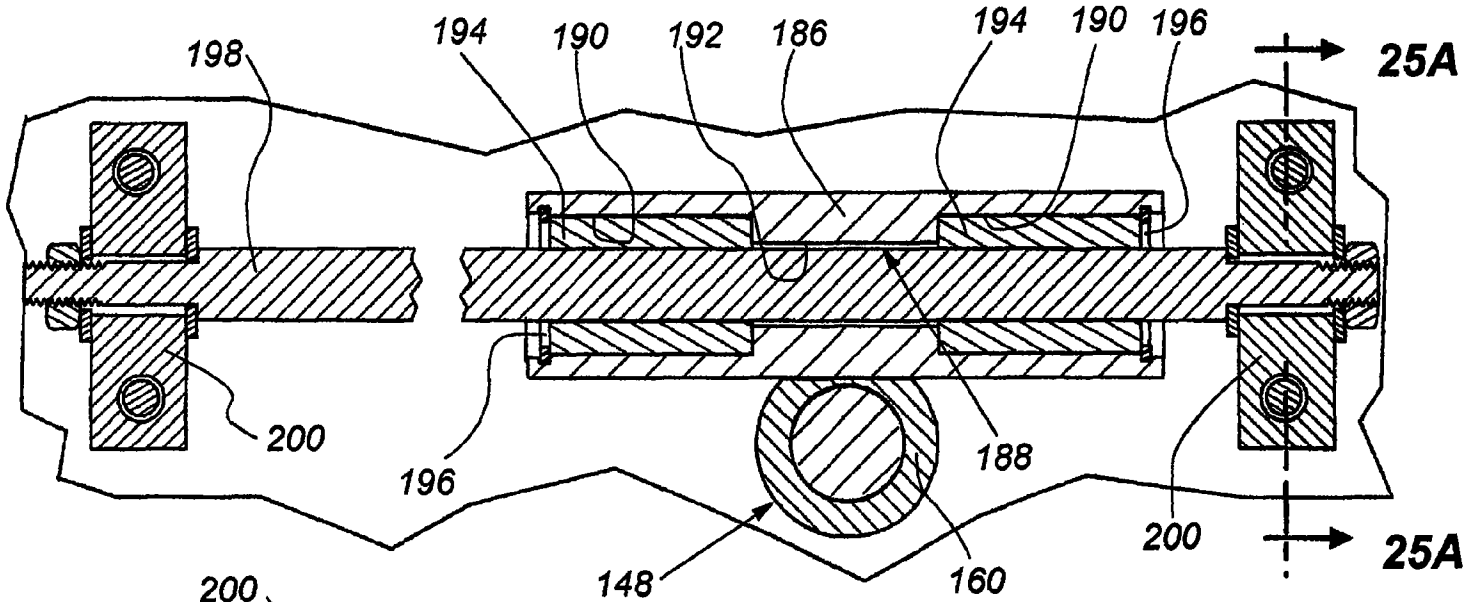
FIG. 25 is an enlarged fragmentary section taken along line 25-25 of FIG. 20.
Figure 25A:
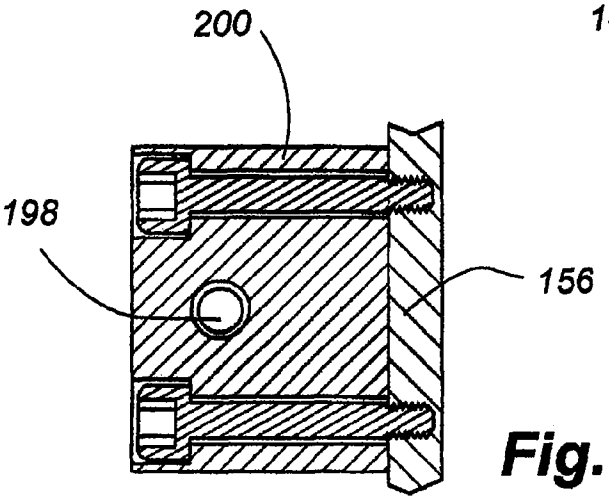
FIG. 25A is a fragmentary section taken along line 25A-25A of FIG. 25.

FIG. 15 is an isometric of an alternative exercise table 140 which is identical to that previously described except in the systems for adjusting the operation and movement of support platform 142. Accordingly, the components of the exercise table shown in FIG. 15 which are not related to the adjustment of the support platform, as will be described hereafter, have not been referenced by new reference numerals but rather have reference numerals identical to those in the embodiment of the exercise table shown in FIGS. 1-14. In the table illustrated in FIG. 15, the support platform 142 again has head 36 and shoulder 38 supports at the head end of the platform 142 but the foot end of the support platform is different. The platform, as in the embodiment of FIGS. 1-14, is connected to the head ends 143 (FIG. 18) of a plurality of resilient members in the form of return coil springs 144 but the coil springs are anchored at their foot ends 146 to an anchor rod 148 which is different from the anchor bar of FIGS. 1-14 and is adjustably mounted on the frame 150 of the exercise table. Movement of the support platform toward the foot end 152 of the table under the bias of the coil springs is limited by an adjustable abutment stop system 154 which will also be described in detail hereafter.

With initial reference to FIGS. 15-19 and 25-30, the selectively moveable anchor bar 148 (FIG. 15) can be seen to extend transversely between opposite side walls 156 of the exercise table and includes a plurality of longitudinally spaced anchor loops 158 to which the foot end 146 of the coil springs 144 are attached. The coil springs therefore bias the support platform 142 toward the foot end 152 of the table. It is desirable that the initial spring bias be constant, necessitating a constant spacing between the support platform and the anchor rod, when the support platform is in its initial retracted position, but it is also desirable for different sized individuals that the retracted position of the support platform be adjustable relative to the foot bar 48 to accommodate different sized individuals so if the support platform is retractably positioned at one location for a given sized individual, the anchor rod 148 needs to be relatedly positioned to maintain the desired bias from the coil springs. The embodiment of FIGS. 15-34A permits the platform to be selectively positioned with respect to the foot bar 48 while maintaining the same initial tension of the springs regardless of the positioning of the support platform relative to the foot bar 48.

Figure 26:
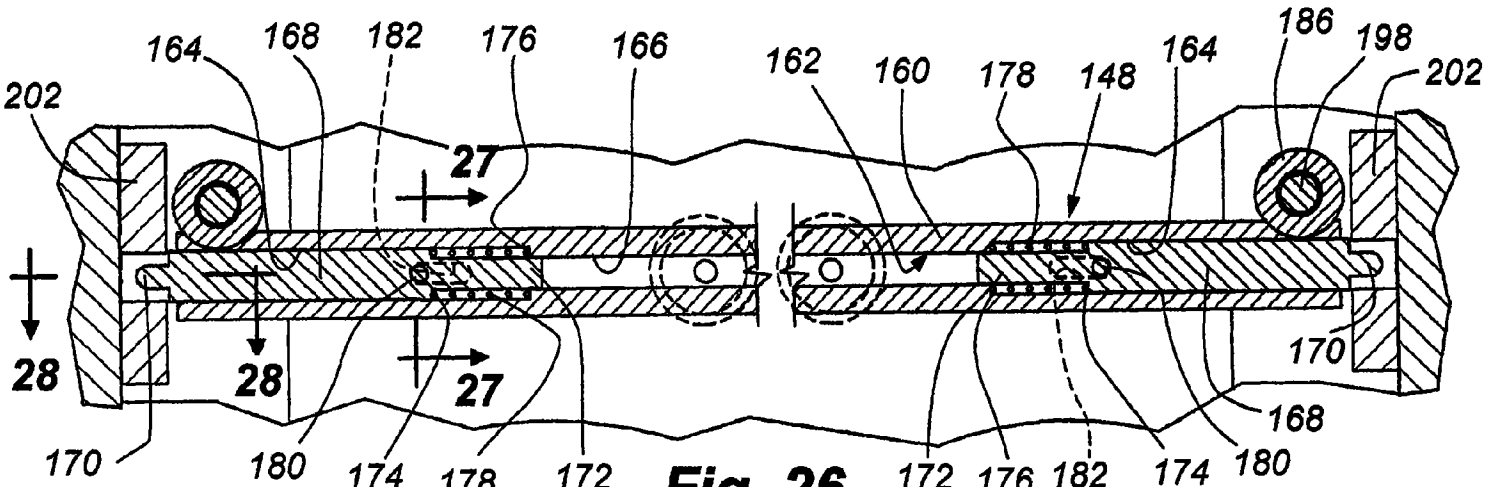
FIG. 26 is an enlarged fragmentary section taken along line 26-26 of FIG. 20.

The anchor rod 148, as will be appreciated, extends transversely of the table 140 and with reference to FIG. 26, it can be seen the anchor rod includes an elongated rigid tube 160 which defines a longitudinal cylindrical cavity 162 therein that varies in cross sectional dimension. The cavity has relatively large diameter portions 164 at its opposite ends and a relatively small diameter central portion 166 between the larger diameter portions. Within both larger diameter portions, a slide pin 168 is slidably positioned with both slide pins having an axial extension 170 at its outer end and a reduced diameter portion 172 corresponding to the diameter of the central cavity 166 in the anchor rod. A shoulder 174 is defined between the larger and smaller diameter portions of the slide pins and an opposing shoulder 176 is defined by the larger and smaller diameters of the cavity 162 in the anchor rod. Coil spring 178 is positioned between the shoulders 174 and 176 to bias both slide pins in an outward axial direction.

Figure 27:
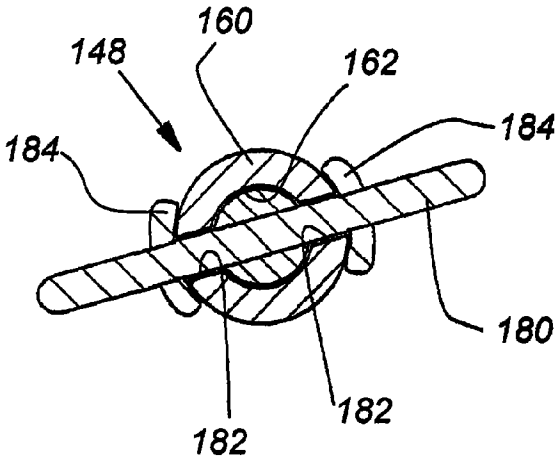
FIG. 27 is an enlarged section taken along line 27-27 of FIG. 26.

With reference to FIG. 27, a transverse finger pin or handle 180 extends through and is connected to each slide pin 168 and rides within diametrically opposed slots 182 in the anchor rod 148 so that movement of the finger pin is limited by the extent of the slots. Each finger pin has a pair of partial sleeves or pinch guards 184 secured thereto. Each finger pin is held in slidable position along the length of the anchor rod so that the slide pin is always desirably positioned for manual manipulation in moving the slide pin inwardly against the bias of an associated coil spring 178 and permitting the slide pin to move linearly outwardly under the bias of the coil spring. The pinch guards prevent the fingers from getting pinched between the spring-loaded pin and the slot in the anchor rod.

Welded to the top of the anchor rod 148 at each end thereof is a short guide cylinder 186 (FIG. 25), also having a longitudinal cylindrical passage 188 therethrough, with the passage having enlarged diameter segments 190 at each end of the guide cylinder and a smaller diameter portion 192 in the center connecting the larger diameter portions. In the larger diameter portions, linear bearings 194 are positioned and held in place by c-clips 196 with the bearings adapted to slide along an associated longitudinally extending support rod 198 at an associated side of the exercise table 140. The support rods are supported at opposite ends by brackets 200 as best seen, for example, in FIGS. 19 and 25. The anchor rod can therefore be slid longitudinally of the table while extending transversely of the table to adjust the location of the anchor rod along the length of the table and accordingly the foot ends 146 of the coil springs which are secured to the anchor rod.

It is desirable to selectively position the anchor rod 148 in any one of a plurality of positions along the length of the exercise table 140 to maintain a desired initial tension or bias in the coil springs 144 depending upon the initial position of the support platform, as mentioned previously. To do so, the central axial extensions 170 from each slide pin 168 cooperate with an associated positioning plate 202 best seen in FIGS. 28 and 29. Each positioning plate is a bar that can be anchored to an associated side of the table through anchor holes 204 and includes four detents 212 and 212*a* along its length which are equally spaced with the three detents closest to the head end 208 of the table 140 having a tapered ramp or cam 210 sloping toward the foot end 152 of the table. The positioning plates are of course laterally aligned on opposite sides of the table and are adapted to receive and retain the anchor rod in one of four designated detents or positions 212 or 212*a* as will be described hereafter.

Once the positioning plates 202 are mounted on the sides of the exercise table 140, the anchor rod 148 can be aligned with associated or aligned detents 212 and 212*a* in the positioning plates so that the axial extensions 170 from each slide pin 168 can be received and releasably retained in a detent. A detent is in reality a location as illustrated in FIG. 28 adjacent to a vertical wall 214 near the lower-most extent of a tapered ramp 210 or in the case of the detent closest to the foot end 152 of the exercise table, it is an oval-shaped cavity 212*a* in which the axial extension of a slide pin can be releasably received.

Figures 28, 29:
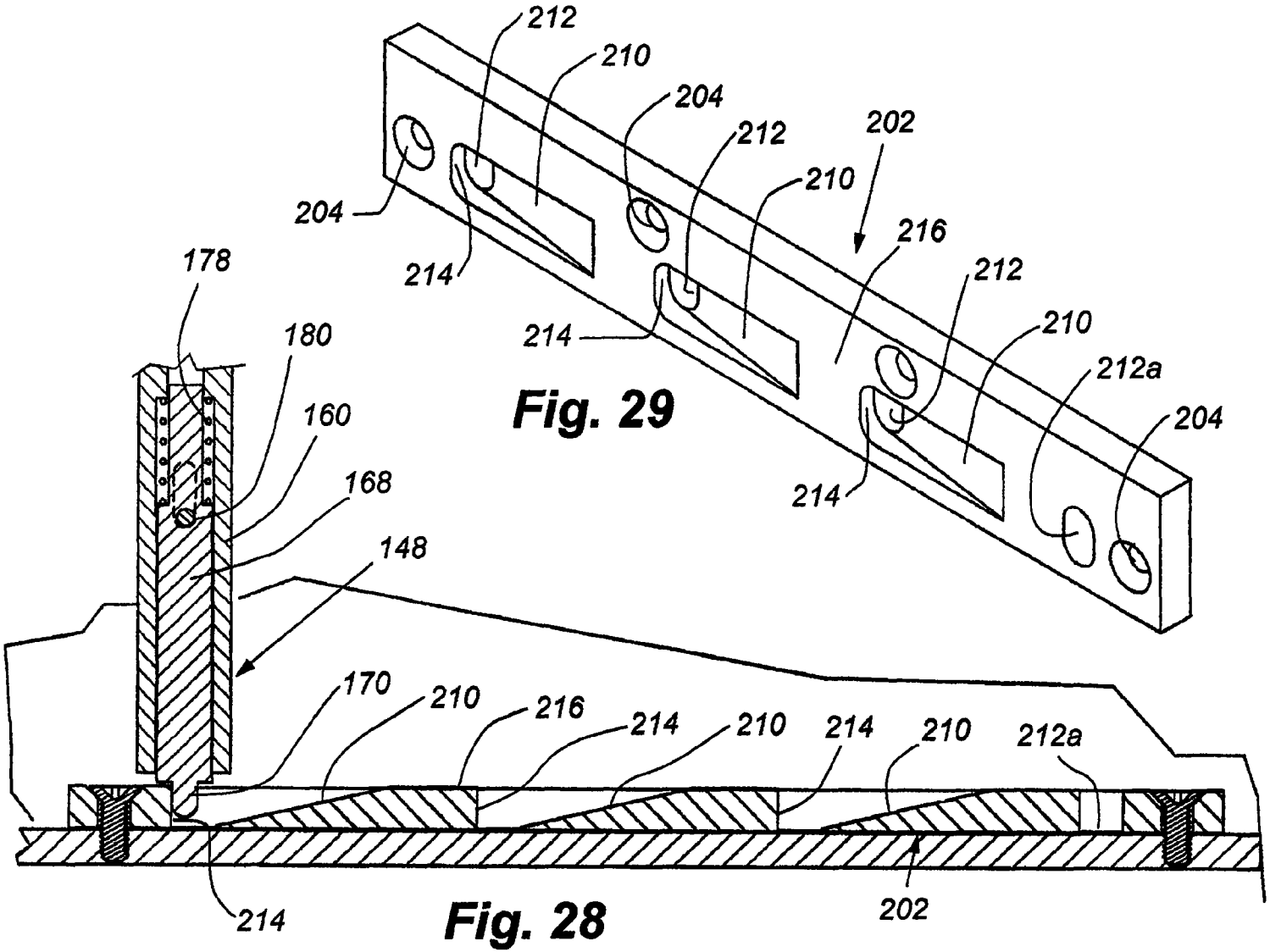
FIG. 28 is an enlarged fragmentary section taken along line 28-28 of FIG. 26.
FIG. 29 is an isometric of the inner wall of a positioning plate used in the adjustment of the anchor bar of the table of FIG. 15.
Figure 30:
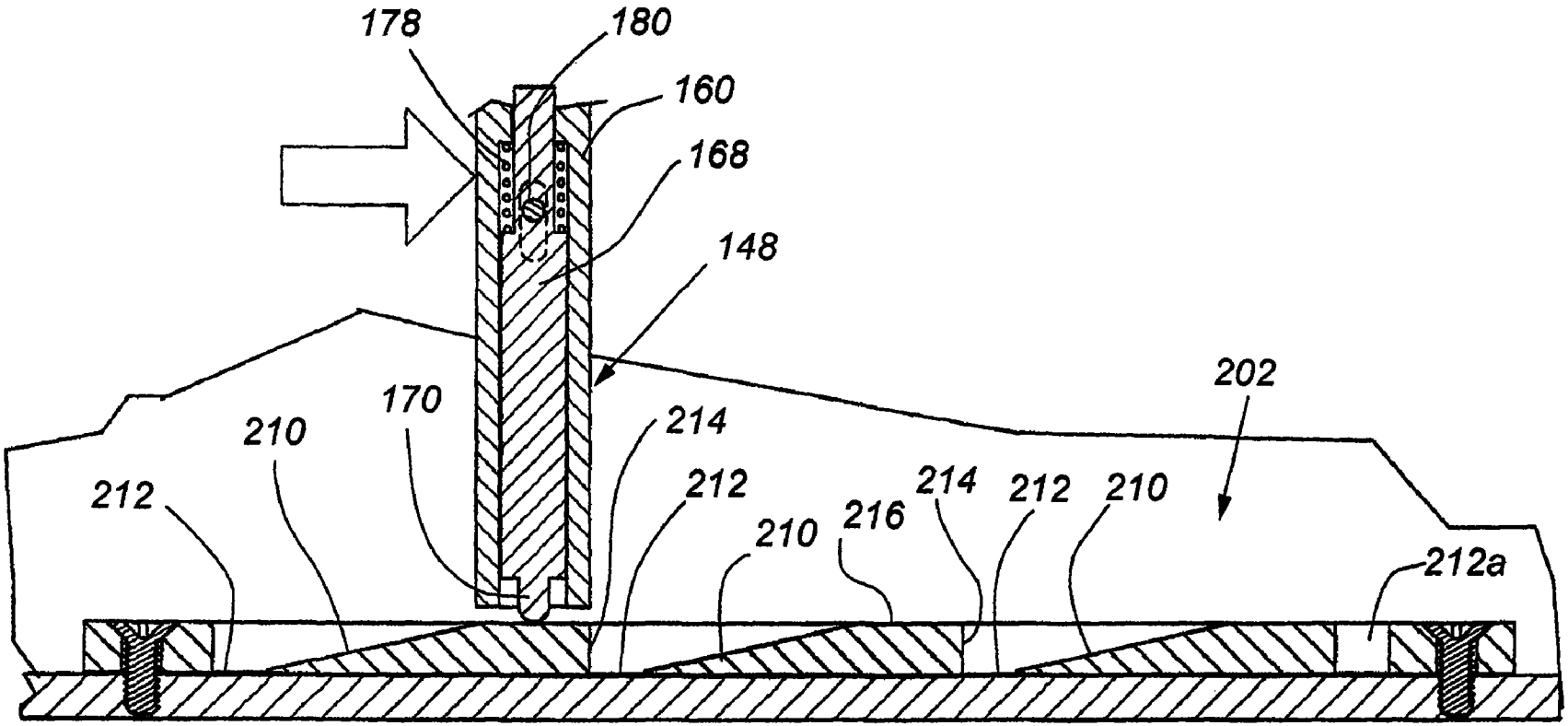
FIG. 30 is a horizontal section showing the interrelationship between the positioning plate shown in FIG. 29 and the anchor bar used in the exercise table of FIG. 15.

Referring to FIGS. 28 and 30, the anchor rod 148 is being shifted between the detent 212 closest to the head end 208 of the table and the next adjacent detent closer to the foot end 152 of the table and as will be appreciated, simply by sliding the anchor rod toward the foot end of the table along the support rods 198, the axial extension 170 on each slide pin 168 will engage the adjacent ramp 210 which acts as a cam in forcing the slide pin axially inwardly of the anchor rod against the bias of the coil spring 178 within the anchor rod. Once the slide pin is retracted far enough, the anchor rod can be slid across the inwardly facing surface 216 of the positioning plate until it encounters the next adjacent detent where the slide pin is pushed outwardly by the coil spring 178 to engage the associated vertical wall 214 of the detent which will hold the pin in that detent due to the bias placed thereon by the coil spring 178. Preferably the springs 144 are disengaged from the anchor rod 148 before its position is adjusted.

It will be appreciated from the above, that by merely sliding the anchor rod 148 toward the foot end 152 of the exercise table 140, the anchor rod becomes releasably fixed in successive detents 212 which will hold the anchor rod at a predetermined position along the length of the exercise table when the axial extension 170 is pulled against vertical wall 214 as the springs 144 are elongated during exercise. When the anchor rod gets to the oval detent 212*a* closest to the foot end of the table, it is received in the oval detent which has no ramp. In moving the anchor rod toward the head end of the table, the finger pin or handle 180 is retracted to move the slide pin 168 against the bias of the internal coil spring 178 disengaging the extension 170 from a detent 212 or 212*a* so the anchor rod can be moved toward the head end 208 of the table until it is desirably positioned in a pre-selected detent.

Of course adjustment in the position of the anchor rod 148 is made in response to or prior to adjusting the static or rest position of the support platform to accommodate exercisers of different body sizes. In order for the springs 144 to always have the same initial tension, the support platform itself, in order to adjust its retracted or rest position, must have its movement toward the foot end of the table limited in correlation with the positioning of the anchor rod. Accordingly, the abutment stop system 154 mentioned previously also has four pre-designated positions so that if the anchor rod is in one position, an abutment stop 218 is positioned in a correlated position.

Figures 32, 33:
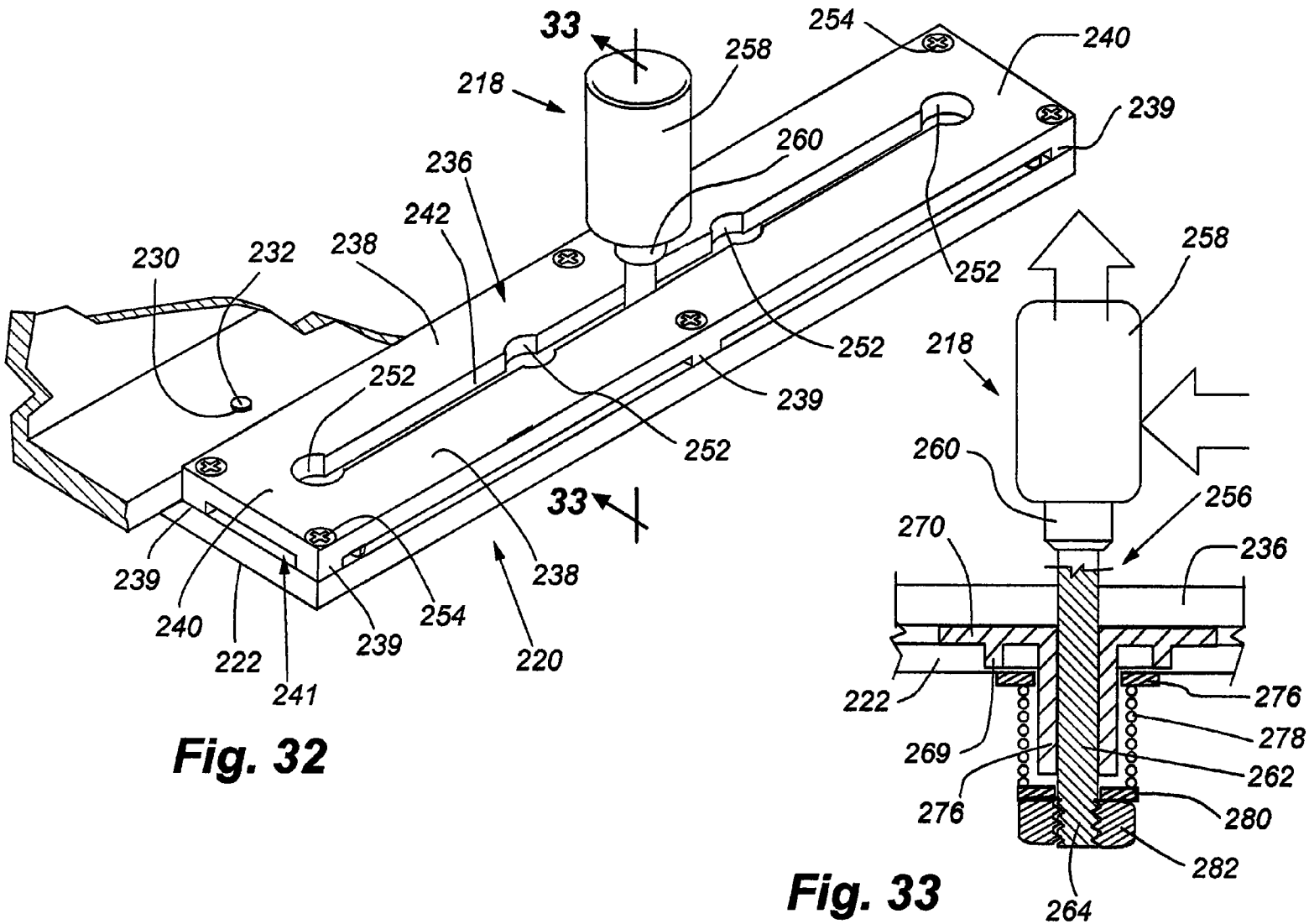
FIG. 32 is a fragmentary isometric showing the adjustable abutment stop connected to a side of the table of FIG. 15.
FIG. 33 is a fragmentary vertical section taken along line 33-33 of FIG. 32.

The abutment stop system 154 is best appreciated by reference to FIGS. 20 through 24 and 31 through 34A. As possibly best appreciated by reference to FIGS. 20 and 32, the abutment stop system includes an abutment stop 218 and a dual-layer assemblage 220 which adjustably receives the abutment stop that is movable between fixed positions defined in the assemblage. The assemblage includes a lower plate 222 that is in reality a rectangular frame having a wide longitudinal side 224, a narrow longitudinal side 226 (FIG. 34) and integral closures 228 (FIG. 31) at opposite ends interconnecting the longitudinal sides. These sides of the lower plate are probably best seen in FIGS. 31, 32 and 34 with the wide longitudinal side further including attachment holes 230 through which threaded fasteners 232 as seen in FIG. 32 can be passed to secure the lower plate to an associated side of the exercise table frame. The lower plate is wide enough so that it extends into the space between the sides of the exercise table. The lower plate defines a longitudinally-extending gap or slot 234 between the longitudinal side members for a purpose to be defined hereafter.

Figure 34A:
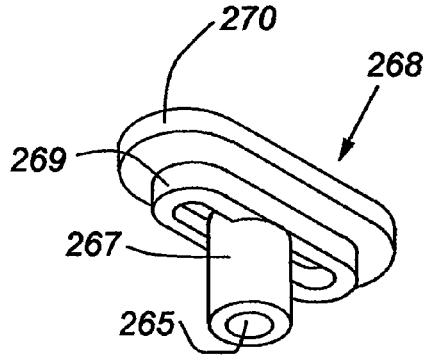
FIG. 34A is a bottom isometric of the stabilizing member used in the abutment stop of FIG. 33.
Figure 34:
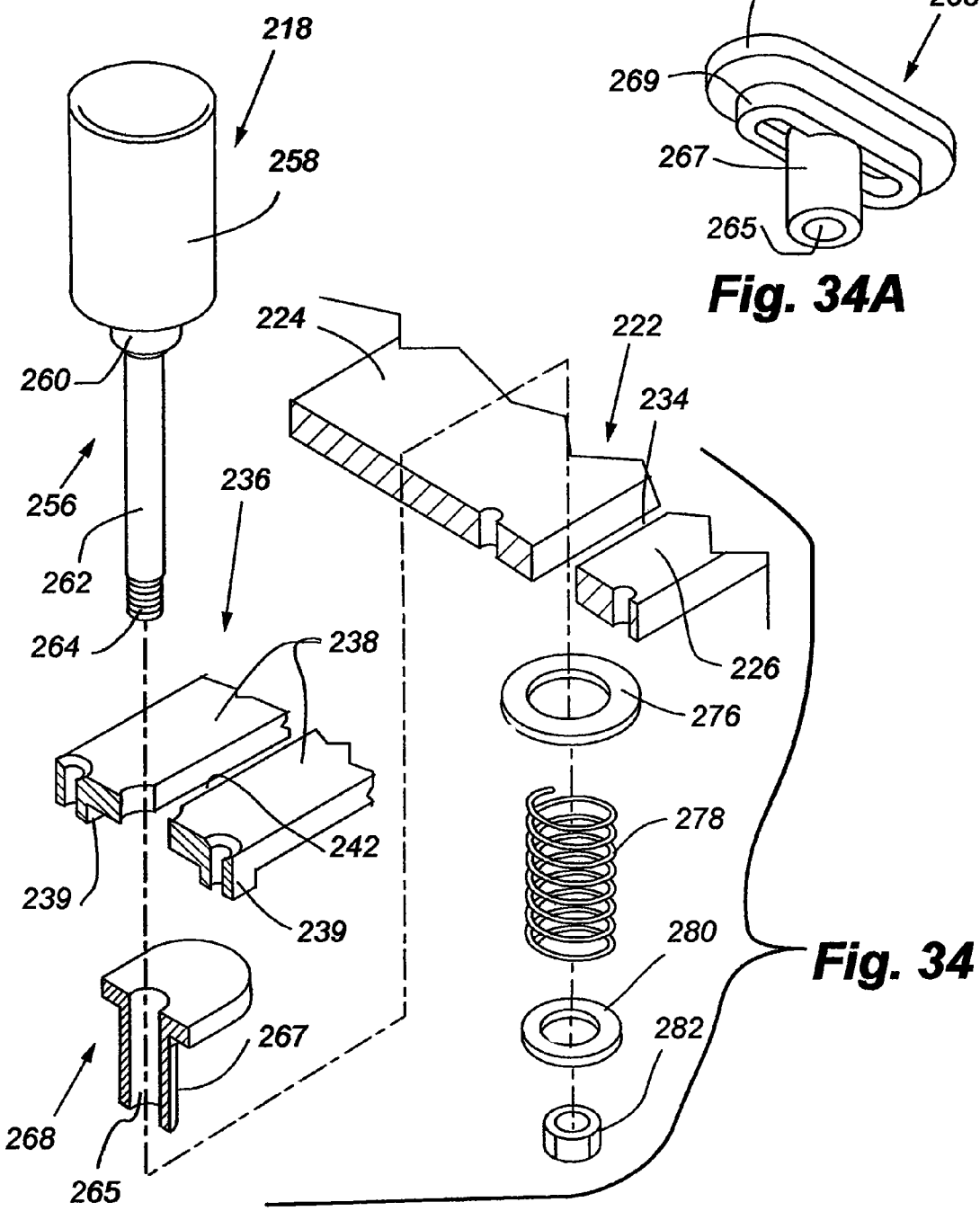
FIG. 34 is an exploded isometric of the abutment stop as shown in FIG. 33.

The assemblage 220 includes an upper plate 236 which is also a rectangular frame but has equal sized longitudinal side members 238 seen in FIGS. 32 and 34 and integral end members 240 interconnecting the associated ends of the longitudinal side members. Again, a gap or slot 242 is defined between the longitudinal side members which is narrower than the longitudinal gap 234 in the lower plate member 222 for a purpose to be described hereafter. The upper plate has legs 239 extending downwardly at its four corners and at the mid-points along its longitudinal side members 238 to create a space 241 between the upper and lower plates. Four equally-spaced vertical cylindrical passages 252 extend through the upper plate and are centered within the slot 242 with the cylindrical passages obviously having a diameter greater than the width of the slot 242 in the upper plate. The dual-plate assemblage 220 is held together with screw-type fasteners 254 as seen best in FIG. 32.

The abutment stop system 154 includes an abutment pin 256 probably best seen in FIGS. 33 and 34 and an enlarged cylindrical head 258 of a relatively firm shock absorptive material such as rubber. The enlarged head is positioned to engage an engagement bar 259 on the underside of the foot end of the support platform 142 to limit movement of the support platform toward the foot end 152 of the exercise table 140. The pin 256 is a downwardly extending shaft of varying diameter. The top 260 of the shaft which extends into and is secured to the cylindrical head 258 as seen in FIG. 33 is of a first diameter with the bottom 262 of the shaft being of a smaller diameter and being threaded on the lowermost end 264. The smaller diameter portion of each pin has a diameter that is equivalent to or slightly less than the width of the slot 242 in the uppermost plate 236 of the assemblage while the upper portion 260 of the pin 256 is of a diameter that is greater than the width of the slot 242 in the upper plate but equal to or slightly less than the diameter of the four spaced vertical passages 252 formed along the slot in the upper plate.

The abutment pin 256 is adapted to be received in a cylindrical passage 265 through a stabilizing member or slide 268 seen best in FIGS. 34 and 34A having an ovular horizontal top plate portion 270 and a lower smaller ovular rib 269 conforming in configuration to the plate portion 270 projecting downwardly therefrom. The narrow dimension of the ovular rib 269 is equal to or slightly narrower than the slot 234 in the lower plate 222 so as to be positionable therein. The top plate portion 270 has a thickness equal to or slightly less than the space 241 between the upper and lower plates so as to be slidable therein. A hollow cylindrical sleeve 267 having the passage 265 extends downwardly from the plate portion 270 through which the abutment pin 256 extends. As mentioned, the ovular plate 270 of the stabilizer member is adapted to be slidably positioned in the space 241 between the upper 236 and lower 222 plates of the assemblage. The stabilizing member may be made of a low friction material so that it slides easily between the upper and lower plates. The narrowmost width of the ovular rib 269 as mentioned is equal to or slightly less than the spacing between the longitudinal sides of the lower plate 222 so that it is guided in its sliding movement along the length of the assemblage by the slot 234 in the lower plate in which it is slidably disposed.

The depending sleeve 267 of the stabilizing member 268 has a diameter that is equal to the broader dimension of the rib 269 and is therefore equal to or slightly less than the spacing between the longitudinal sides 224 and 226 of the lowermost plate 222 in the assemblage so that it too can slide along the length of the slot 234.

The abutment stop 218 is connected to the assemblage of plates by passing the pin 256 first downwardly through the upper plate 236 and subsequently through the stabilizing member 268 with the stabilizing member being positioned so that the upper ovular plate 270 slides in the space 241 between the upper and lower plates. The rib 269 extends into the slot 234 and the sleeve 267 of the stabilizing member protrudes downwardly through the lowermost plate and through an upper washer 276 which abuts the upper end of a compression spring 278 and a lower washer 280 which abuts the lower end of the compression spring 278 so that a nut 282 can be threaded onto the lower threaded end 264 of the pin to hold the pin and the associated enlarged cylindrical head 258 in a slidable relationship to the assemblage. Since the washer 276 fits over sleeve 267 as does spring 278, as a result, the spring pushes the washer 276 against the plate 222 and against washer 280. Washer 280 is confined on pin 256 by the nut 282. The spring 278 therefore biases the abutment stop 218 into one of the four cylindrical passages 252.

Figure 31:
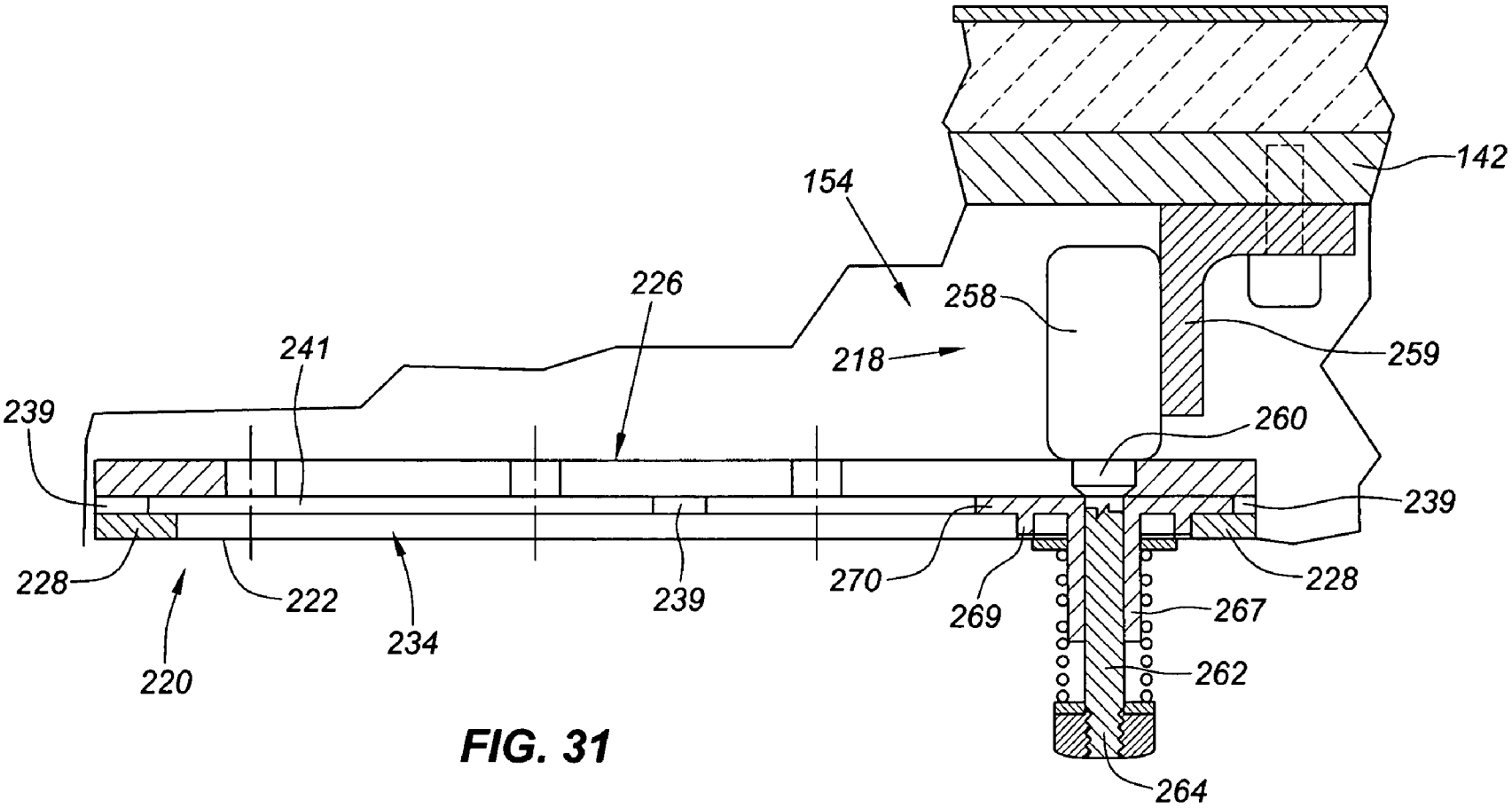
FIG. 31 is a fragmentary vertical section through a side of the table of FIG. 15 showing an adjustable abutment stop system for the support platform.

The compression spring 278 biases the enlarged cylindrical head 258 along with the abutment pin downwardly until the abutment head rests against the top of the upper plate 236 (FIG. 31). The abutment pin 256 is releasably retained in this position at one of four different locations defined by the vertical passages 252 as will be described hereafter but can be removed from those locations by lifting the abutment head 258 against the bias of the spring 278, as illustrated with an arrow in FIG. 33, and sliding the abutment pin longitudinally of the assemblage.

When the abutment head 258 is in its lowermost position (FIG. 31), the upper portion 260 of the abutment pin 256 which is of relatively large diameter is horizontally aligned with the slot 242 in the uppermost plate 236 but as mentioned previously, has a larger diameter than the slot 242 so it can only be moved into horizontal alignment with the slot when the pin is positioned in one of the cylindrical passages 252 formed through the upper plate. Accordingly, the abutment stop 218 can only be lowered when it is positioned in one of the four cylindrical passages 252. The compression spring 278 biases the abutment stop downwardly so that when the pin is in a cylindrical passage, the abutment head rests against the top of the uppermost plate and the upper portion 260 of the abutment pin is horizontally aligned with the slot 242 in the uppermost plate. Since the uppermost portion of the pin is wider than the slot in the uppermost plate, it is confined within a passage 252 and held in that position. To move the abutment pin between the four positions identified by the vertical passages so that it is correlated with the positioning of the anchor rod 148 previously described, the enlarged head 258 is lifted against the bias of the compression spring 278 until the narrower lower portion of the abutment pin is horizontally aligned with the slot 242 in the upper plate which as mentioned previously is equal to or smaller in diameter than the slot 242 in the upper plate so that it can be slid along the slot from one vertical passage to another. Accordingly, the abutment pin is easily moved between the four fixed positions by lifting the enlarged head, sliding the abutment pin to the desired cylindrical passage 252 and then allowing the abutment head to be lowered through the bias of the compression spring.

As mentioned previously, there are four selected positions for the abutment stop 218 as well as four selected positions for the anchor rod 148 and those positions are equally spaced. Accordingly, if the abutment stop is positioned in one preselected position, the anchor rod can be positioned in a corresponding position so the coil springs 144 have a predetermined initial tension and that predetermined tension can be maintained by making sure the abutment stop is in a fixed position that correlates with the fixed position of the anchor rod.

While it is not always necessary, there can be an abutment stop system 154 on both sides of the exercise table 140 or only on one side but if there were two they would work identically and would be aligned with each other on opposite sides of the exercise table.

Although the present invention has been described with a certain degree of particularity, it is understood the disclosure has been made by way of example and changes in detail or structure may be made without departing from the spirit of the invention as defined in the appended claims.

The invention claimed is:

1. An exercise table, comprising:

a substantially horizontally disposed frame defining tracks along opposite longitudinal sides thereof and having a head and foot end, openings defined by and located interior to the frame, a support platform mounted for reciprocal movement along said tracks, a foot bar near said foot end of said frame, and downwardly extending legs near said head and foot end of said frame, said legs being inwardly located relative to the periphery of said frame, wherein said openings are in vertical alignment with said legs whereby tables can be nestably stacked with the legs of an overlying table projecting through said openings of an underlying frame into adjacent relationship with the legs of said underlying table.

2. The table of claim 1 wherein said legs further include a substantially horizontal component and downwardly and inwardly tapering side components interconnected with said substantially horizontal components.

3. The table of claim 1 further including pulleys projecting above said frame, said pulleys being vertically movable to adjust the elevation of said pulleys above said frame.

4. The table of claim 3 wherein said pulleys are telescopically movable relative to said frame.

5. An exercise table, comprising:

a substantially horizontally disposed frame defining tracks along opposite longitudinal sides thereof and having a head end and a foot end, an opening defined by and located interior to the substantially horizontally disposed frame near the head end, a support platform mounted for reciprocal movement along said tracks, said platform including shoulder rests normally projecting substantially above the remainder of said platform, said shoulder rests being hingedly connected to the remainder of said platform, and pivotally movable while remaining connected to said platform to a position that is close in height to the height of the remainder of said platform and that does not extend across said opening such that a frame of a vertically stacked table can be positioned in parallel closely adjacent relationship; and legs near said head end and foot end of said frame, said legs tapering inwardly relative to the periphery of said frame and downwardly from said frame, and said frame including another opening defined by and located interior to the substantially horizontally disposed frame near said foot end of said frame, said openings being vertically above said legs whereby tables can be nestably stacked with the legs of an overlying table projecting through said openings of an underlying table into adjacent relationship with the legs of said underlying table.

6. An exercise table, comprising:

a substantially horizontally disposed frame having longitudinally extending side frame members defining tracks along opposite sides of said frame and having a head end and a foot end, a support platform supported on said frame for reciprocal movement along said tracks, an anchor rod extending between said side frame members and positioned between said support platform and said foot end of said frame, an anchor rod adjustment system which movably couples said anchor rod to said side frame members, wherein said anchor rod adjustment system is configured to move longitudinally along said side frame members without completely removing said anchor rod from said side frame members, a plurality of resilient members anchored to said support platform at a head end of the resilient members and to said anchor rod at a foot end of said resilient members to bias said support platform toward said foot end of said frame, wherein said anchor rod adjustment system includes retractable axially extending pins at opposite ends of said anchor rod and manually operable handles for selectively retracting said pins, an internal bias system in said anchor rod for biasing said pins toward an extended position, a pair of opposed positioning systems on said side frame members, said positioning systems including a plurality of detents for releasably receiving and retaining said pins to releasably position said anchor rod in selected ones of a plurality of positions.

7. The exercise table of claim 6, further comprising an abutment stop releasably coupled to the frame at a plurality of releasably fixed positions.

8. The exercise table of claim 7 further including cam surfaces on said positioning systems adjacent to at least some of said detents such that said anchor rod can be moved toward said foot end of said frame by sliding said anchor rod toward said foot end of said frame and permitting said cam surfaces to forcibly retract said pins to permit movement of said anchor rod between said detents.

9. The exercise table of claim 6, further comprising:

a longitudinally adjustable abutment stop system mounted on at least one of said side frame members to establish an adjustable location for limiting movement of said support platform toward said foot end of said frame, said abutment stop system including an abutment stop non-removably connected to said frame, and movable between a plurality of longitudinally releasably fixed positions.

10. An exercise table comprising in combination:

a substantially horizontally disposed frame having longitudinally extending side frame members defining tracks along opposite sides of said frame and having a head end and a foot end, a support platform supported on said frame for reciprocal movement along said tracks, an anchor rod extending between said side frame members and positioned between said support platform and said foot end of said frame, a plurality of resilient members anchored to said support platform at a head end of said resilient members and to said anchor rod at a foot end of said resilient members to bias said support platform toward said foot end of said frame, an abutment system for limiting movement of said support platform toward said anchor rod, and an anchor rod adjustment system including retractable axially extending pins at opposite ends of said anchor rod and manually operable handles for selectively retracting said pins, an internal bias system in said anchor rod for biasing said pins toward an extended position, a pair of opposed positioning systems mounted on said side frame members, said positioning systems including a plurality of detents for releasably receiving and retaining said pins to releasably position said anchor bar in selected ones of a plurality of positions, and cam surfaces on said positioning systems adjacent to at least some of said detents such that said anchor rod can be moved toward said foot end of said frame without manual operation of said handles by sliding said anchor rod toward said foot end of said frame and permitting said cam surfaces to forcibly retract said pins to permit movement of said anchor rod between said detents.

11. A stackable reformer that is configured to assume an operating mode and a storage mode, comprising:

a frame which defines at least one open area;

a support platform movably coupled to the frame;

legs that are coupled to and extend downward from the frame and that are configured to extend through at least one open area of an underlying, similarly configured reformer when the stackable reformer is in the storage mode; and shoulder pads that extend upward when the stackable reformer is in an operating mode and that are movable to a position close in height to the top of the frame when the stackable reformer is in the storage mode.

12. The stackable reformer of claim 11, wherein the legs each include tapered sections extending downward from the frame.

13. The stackable reformer of claim 11, further comprising:

a foot bar that extends upward when the stackable reformer is in the operating mode and that is movable to a position close in height to the top of the frame when the stackable reformer is in the storage mode.

14. The stackable reformer of claim 11, further comprising:

pulleys that extend upward when the stackable reformer is in the operating mode and that are movable to a position close in height to the platform when the stackable reformer is in the storage mode.

15. The stackable reformer of claim 11, further comprising, a plurality of support pads that are mounted to an underside of the frame.

16. The stackable reformer of claim 15, wherein the support pads have a height that is substantially the same as the distance above the frame that the shoulder pads extend when the stackable reformer is in the storage mode.

17. The stackable reformer of claim 11, further comprising:

an anchor bar movably coupled to the frame; and a plurality of springs coupled to the anchor bar and the support platform;

wherein the anchor bar is movably configured to move toward a foot end of the frame without manual operation of the anchor bar.

18. The stackable reformer of claim 17, further comprising:

a longitudinally adjustable abutment stop system mounted to the frame to establish an adjustable location for limiting movement of the support platform toward the foot end of the frame, wherein the abutment stop system includes an abutment stop non-removably connected to the frame, and movable between a plurality of longitudinally releasably fixed positions.

* * * * *